US010196796B2

(12) United States Patent
Iwamura et al.

(10) Patent No.: US 10,196,796 B2
(45) Date of Patent: Feb. 5, 2019

(54) CONSTRUCTION MACHINE CONTROL SYSTEM, CONSTRUCTION MACHINE, AND CONSTRUCTION MACHINE CONTROL METHOD

(71) Applicant: Komatsu Ltd., Tokyo (JP)

(72) Inventors: Tsutomu Iwamura, Yokohama (JP); Yoshiro Iwasaki, Naka-gun (JP); Masashi Ichihara, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 55 days.

(21) Appl. No.: 15/322,813

(22) PCT Filed: May 31, 2016

(86) PCT No.: PCT/JP2016/066077
§ 371 (c)(1),
(2) Date: Dec. 29, 2016

(87) PCT Pub. No.: WO2016/186218
PCT Pub. Date: Nov. 24, 2016

(65) Prior Publication Data
US 2017/0342678 A1 Nov. 30, 2017

(51) Int. Cl.
*E02F 3/43* (2006.01)
*E02F 3/36* (2006.01)
(Continued)

(52) U.S. Cl.
CPC ..... *E02F 3/435* (2013.01); *E02F 3/32* (2013.01); *E02F 3/3677* (2013.01); *E02F 9/20* (2013.01);
(Continued)

(58) Field of Classification Search
CPC ..... E02F 3/435; E02F 3/32; E02F 9/20; E02F 9/262; E02F 9/265; E02F 9/2296; E02F 9/2033; E02F 3/3677
See application file for complete search history.

(56) References Cited

U.S. PATENT DOCUMENTS

2014/0297040 A1 10/2014 Baba et al.
2015/0345114 A1 12/2015 Nomura et al.
(Continued)

FOREIGN PATENT DOCUMENTS

CN 103852059 A 6/2014
CN 103917717 A 7/2014
(Continued)

OTHER PUBLICATIONS

International Search Report dated Aug. 30, 2016, issued for PCT/JP2016/066077.
(Continued)

*Primary Examiner* — Nadeem Odeh
*Assistant Examiner* — Michael V Kerrigan
(74) *Attorney, Agent, or Firm* — Locke Lord LLP

(57) ABSTRACT

A construction machine control system includes: a target construction ground shape generation unit generating a target construction ground shape indicating a target shape of an excavation target; a tilting data calculation unit calculating tilting data of a bucket tilted about a tilting axis; a regulation point position data calculation unit calculating position data of a regulation point set in the bucket based on external shape data of the bucket including at least width data of the bucket; a tilting target ground shape calculation unit calculating a tilting target ground shape extending in a lateral direction of the bucket in the target construction ground shape based on the position data of the regulation point, the target construction ground shape, and the tilting
(Continued)

data; and a working device control unit controlling a tilting of the bucket based on a distance between the regulation point and the tilting target ground shape.

7 Claims, 22 Drawing Sheets

(51) Int. Cl.

| | |
|---|---|
| ***E02F 9/20*** | (2006.01) |
| ***E02F 9/22*** | (2006.01) |
| ***E02F 9/26*** | (2006.01) |
| ***E02F 3/32*** | (2006.01) |

(52) U.S. Cl.
CPC ..... *E02F 9/2033* (2013.01); *E02F 9/2296* (2013.01); *E02F 9/262* (2013.01); *E02F 9/265* (2013.01)

(56) References Cited

U.S. PATENT DOCUMENTS

| | | | | |
|---|---|---|---|---|
| 2016/0097184 | A1 | 4/2016 | Matsuyama et al. | |
| 2016/0251824 | A1 | 9/2016 | Arimatsu et al. | |
| 2016/0251835 | A1* | 9/2016 | Kitajima ..... | E02F 3/3663 701/50 |
| 2016/0273186 | A1 | 9/2016 | Kami et al. | |
| 2016/0289928 | A1 | 10/2016 | Kitajima | |
| 2017/0107688 | A1 | 4/2017 | Fujii et al. | |

FOREIGN PATENT DOCUMENTS

| | | | |
|---|---|---|---|
| CN | 105339560 | A | 2/2016 |
| CN | 105378186 | A | 3/2016 |
| DE | 112013000165 | T5 | 12/2014 |
| DE | 112014000077 | T5 | 2/2016 |
| JP | 2014-074319 | A | 4/2014 |
| KR | 10-2016-0005016 | A | 1/2016 |
| KR | 10-2016-0009532 | A | 1/2016 |
| KR | 10-2016-0021073 | A | 2/2016 |
| KR | 10-2017-0045146 | A | 4/2017 |
| WO | 2015/186179 | A1 | 12/2015 |
| WO | 2015/186180 | A1 | 12/2015 |

OTHER PUBLICATIONS

Office Action dated Dec. 4, 2018 issued for corresponding German patent application No. 11 2016 000 090.1.

* cited by examiner

CONSTRUCTION MACHINE CONTROL SYSTEM, CONSTRUCTION MACHINE, AND CONSTRUCTION MACHINE CONTROL METHOD

FIELD

The present invention relates to a construction machine control system, a construction machine, and a construction machine control method.

BACKGROUND

As disclosed in Patent Literature 1, a construction machine including a working device with a tilting type bucket is known.

CITATION LIST

Patent Literature

Patent Literature 1: WO 2015/186179

SUMMARY

Technical Problem

In a technical field involving with a control for a construction machine, there is known a working device control which controls a position or a posture of at least one of a boom, an arm, and a bucket of a working device with respect to a target construction ground shape indicating a target shape of an excavation target. When the working device control is performed, a construction based on the target construction ground shape is performed.

In a construction machine with a tilting type bucket, working efficiency of the construction machine is deteriorated when an original control is not performed for the tilting type bucket in addition to the existing working device control.

An aspect of the invention provides a construction machine control system, a construction machine, and a construction machine control method capable of suppressing deterioration in working efficiency in a construction machine with a working device including a tilting type bucket.

Solution to Problem

According to a first aspect of the present invention, a construction machine control system with a working device including an arm and a bucket being rotatable with respect to the arm about a bucket axis and a tilting axis orthogonal to the bucket axis, the construction machine control system comprises: a target construction ground shape generation unit which generates a target construction ground shape indicating a target shape of an excavation target; a tilting data calculation unit which calculates tilting data of the bucket tilted about the tilting axis; a regulation point position data calculation unit which calculates position data of a regulation point set in the bucket based on external shape data of the bucket including at least width data of the bucket; a tilting target ground shape calculation unit which calculates a tilting target ground shape extending in a lateral direction of the bucket in the target construction ground shape based on the position data of the regulation point, the target construction ground shape, and the tilting data; and a working device control unit which controls a tilting of the bucket based on a distance between the regulation point and the tilting target ground shape.

According to a second aspect of the present invention, a construction machine comprises: an upper swinging body; a lower traveling body which supports the upper swinging body; a working device which includes the arm and the bucket and is supported by the upper swinging body; and the construction machine control system according to the first aspect.

According to a third aspect of the present invention, a construction machine control method for a construction machine with a working device including an arm and a bucket being rotatable with respect to the arm about a bucket axis and a tilting axis orthogonal to the bucket axis, the construction machine control method comprises: generating a target construction ground shape indicating a target shape of an excavation target; calculating tilting data of the bucket tilted about the tilting axis; calculating position data of a regulation point set in the bucket based on external shape data of the bucket including at least width data of the bucket; calculating a tilting target ground shape extending in a lateral direction of the bucket in the target construction ground shape based on the position data of the regulation point, the target construction ground shape, and the tilting data; and outputting a control signal of controlling a tilting of the bucket based on a distance between the regulation point and the tilting target ground shape.

Advantageous Effects of Invention

According to the aspect of the invention, it is possible to provide a construction machine control system, a construction machine, and a construction machine control method capable of suppressing deterioration in working efficiency in a construction machine with a working device including a tilting type bucket.

DESCRIPTION OF EMBODIMENTS

Hereinafter, embodiments of the invention will be described with reference to the drawings, but the invention is not limited thereto. The components of the embodiments described below can be appropriately combined with one another. Further, there is a case where a part of the components are not used.

In the description below, a positional relation of the components will be described based on a global coordinate system (an XgYgZg coordinate system) and a local coordinate system (an XYZ coordinate system). The global coordinate system is a coordinate system which indicates an absolute position defined by a Global Navigation Satellite System (GNSS) such as a Global Positioning System (GPS). The local coordinate system is a coordinate system which indicates a relative position of a construction machine with respect to a reference position.

[Construction Machine]

Figure 1:
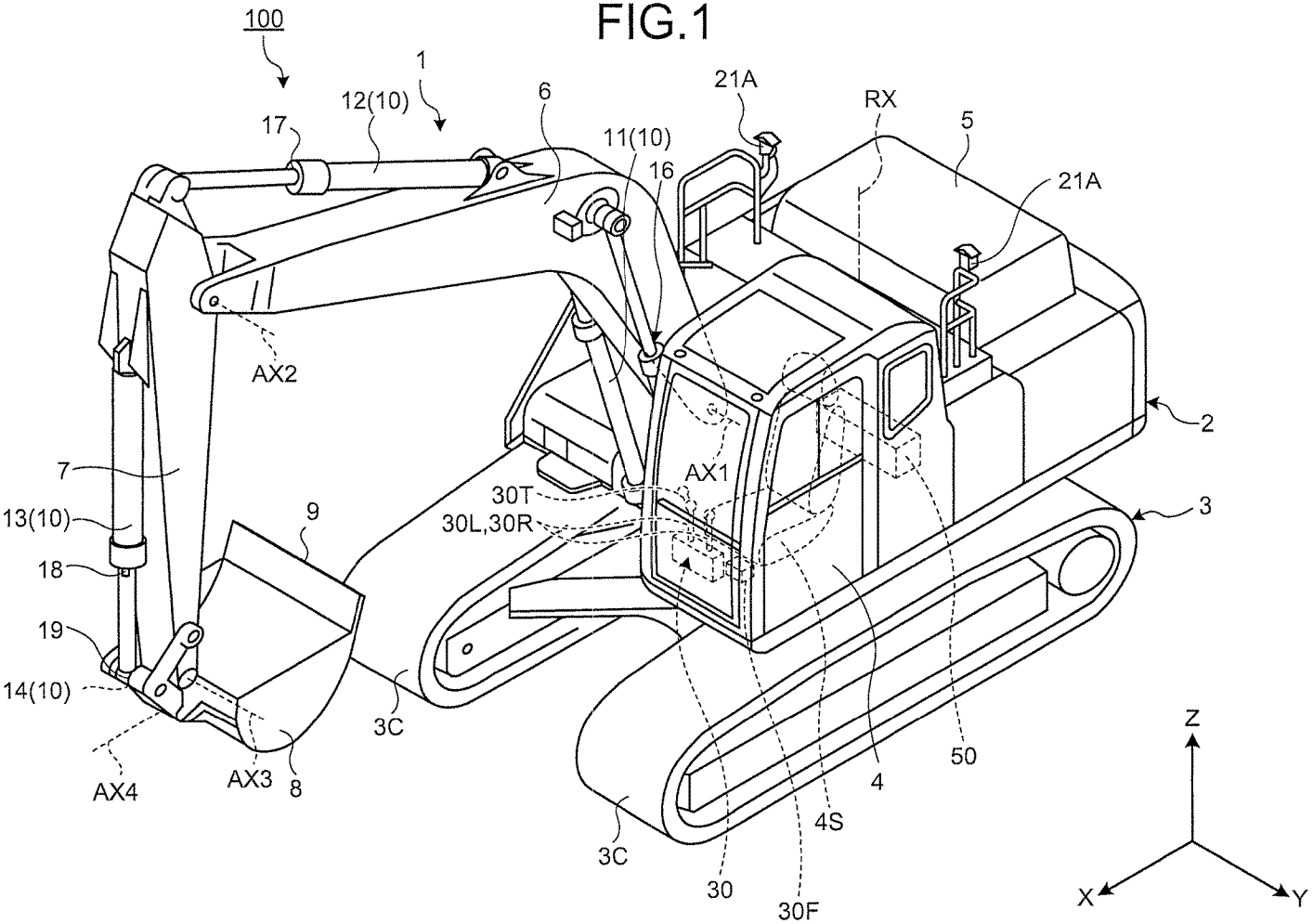
FIG. 1 is a perspective view illustrating an example of a construction machine according to the embodiment.

FIG. 1 is a perspective view illustrating an example of a construction machine 100 according to the embodiment. In the embodiment, an example in which the construction machine 100 is an excavator will be described. In the description below, the construction machine 100 will be appropriately referred to as the excavator 100.

As illustrated in FIG. 1, the excavator 100 includes a working device 1 which is operated by hydraulic oil, an upper swinging body 2 which is a vehicle body supporting the working device 1, a lower traveling body 3 which is a traveling device supporting the upper swinging body 2, a manipulation device 30 which is used to manipulate the working device 1, and a control device 50 which controls the working device 1. The upper swinging body 2 is able to swing about a swing axis RX while being supported by the lower traveling body 3.

The upper swinging body 2 includes a cab 4 on which an operator gets and a machine room 5 which receives an engine and a hydraulic pump. The cab 4 includes a driver seat 4S on which the operator sits. The machine room 5 is disposed behind the cab 4.

The lower traveling body 3 includes a pair of crawlers 3C. By the rotation of the crawlers 3C, the excavator 100 travels. Furthermore, the lower traveling body 3 may include a tire.

The working device 1 is supported by the upper swinging body 2. The working device 1 includes a boom 6 which is connected to the upper swinging body 2 through a boom pin, an arm 7 which is connected to the boom 6 through an arm pin, and a bucket 8 which is connected to the arm 7 through a bucket pin and a tilting pin. The bucket 8 includes a tip 9. In the embodiment, the tip 9 of the bucket 8 is a straight blade edge which is provided in the bucket 8. Furthermore, the tip 9 of the bucket 8 may be a convex blade edge which is provided in the bucket 8.

The boom 6 is rotatable about a boom axis AX1 which is a rotation axis with respect to the upper swinging body 2. The arm 7 is rotatable about an arm axis AX2 which is a rotation axis with respect to the boom 6. The bucket 8 is rotatable about each of a bucket axis AX3 which is a rotation axis and a tilting axis AX4 which is a rotation axis orthogonal to the bucket axis AX3 with respect to the arm 7. The rotation axis AX1, the rotation axis AX2, and the rotation axis AX3 are parallel to one another. The rotation axes AX1, AX2, and AX3 are orthogonal to an axis parallel to the swing axis RX. The rotation axes AX1, AX2, and AX3 are parallel to the Y axis of the local coordinate system. The swing axis RX is parallel to the Z axis of the local coordinate system. A direction parallel to the rotation axes AX1, AX2, and AX3 indicates a vehicle width direction of the upper swinging body 2. A direction parallel to the swing axis RX indicates a vertical direction of the upper swinging body 2. A direction orthogonal to the rotation axes AX1, AX2, and AX3 and the swing axis RX indicates an anteroposterior direction of the upper swinging body 2. A direction in which the working device 1 exists when the operator sits on the driver seat 4S indicates a front direction.

The working device 1 is operated by power generated by a hydraulic cylinder 10. The hydraulic cylinder 10 includes a boom cylinder 11 which operates the boom 6, an arm cylinder 12 which operates the arm 7, and a bucket cylinder 13 and a tilting cylinder 14 which operate the bucket 8.

Further, the working device 1 includes a boom stroke sensor 16 which detects a boom stroke indicating a driving amount of the boom cylinder 11, an arm stroke sensor 17 which detects an arm stroke indicating a driving amount of the arm cylinder 12, a bucket stroke sensor 18 which detects a bucket stroke indicating a driving amount of the bucket cylinder 13, and a tilting stroke sensor 19 which detects a tilting stroke indicating a driving amount of the tilting cylinder 14. The boom stroke sensor 16 is disposed at the boom cylinder 11. The arm stroke sensor 17 is disposed at the arm cylinder 12. The bucket stroke sensor 18 is disposed at the bucket cylinder 13. The tilting stroke sensor 19 is disposed at the tilting cylinder 14.

The manipulation device 30 is disposed at the cab 4. The manipulation device 30 includes a manipulation member that is manipulated by the operator of the excavator 100. The operator manipulates the manipulation device 30 to operate the working device 1. In the embodiment, the manipulation device 30 includes a right working device manipulation lever 30R, a left working device manipulation lever 30L, a tilting manipulation lever 30T, and a manipulation pedal 30F.

The boom 6 is lowered when the right working device manipulation lever 30R at a neutral position is manipulated forward and the boom 6 is raised when the right working device manipulation lever is manipulated backward. The bucket 8 performs a dumping operation when the right working device manipulation lever 30R at a neutral position is manipulated rightward and the bucket 8 performs an excavating operation when the right working device manipulation lever is manipulated leftward.

The arm 7 performs a dumping operation when the left working device manipulation lever 30L at a neutral position is manipulated forward and the arm 7 performs an excavating operation when the left working device manipulation lever is manipulated backward. The upper swinging body 2 swings rightward when the left working device manipulation lever 30L at a neutral position is manipulated rightward and the upper swinging body 2 swings leftward when the left working device manipulation lever is manipulated leftward.

Furthermore, the operation directions of the right working device manipulation lever 30R and the left working device manipulation lever 30L, the operation direction of the working device 1, and the swing direction of the upper swinging body 2 may not have the above-described relation.

The control device 50 includes a computing system. The control device 50 includes a processor such as a Central Processing Unit (CPU), a storage device including a non-volatile memory such as a Read Only Memory (ROM) and a volatile memory such as a Random Access Memory (RAM), and an input/output interface device.

[Bucket]

Figure 2:
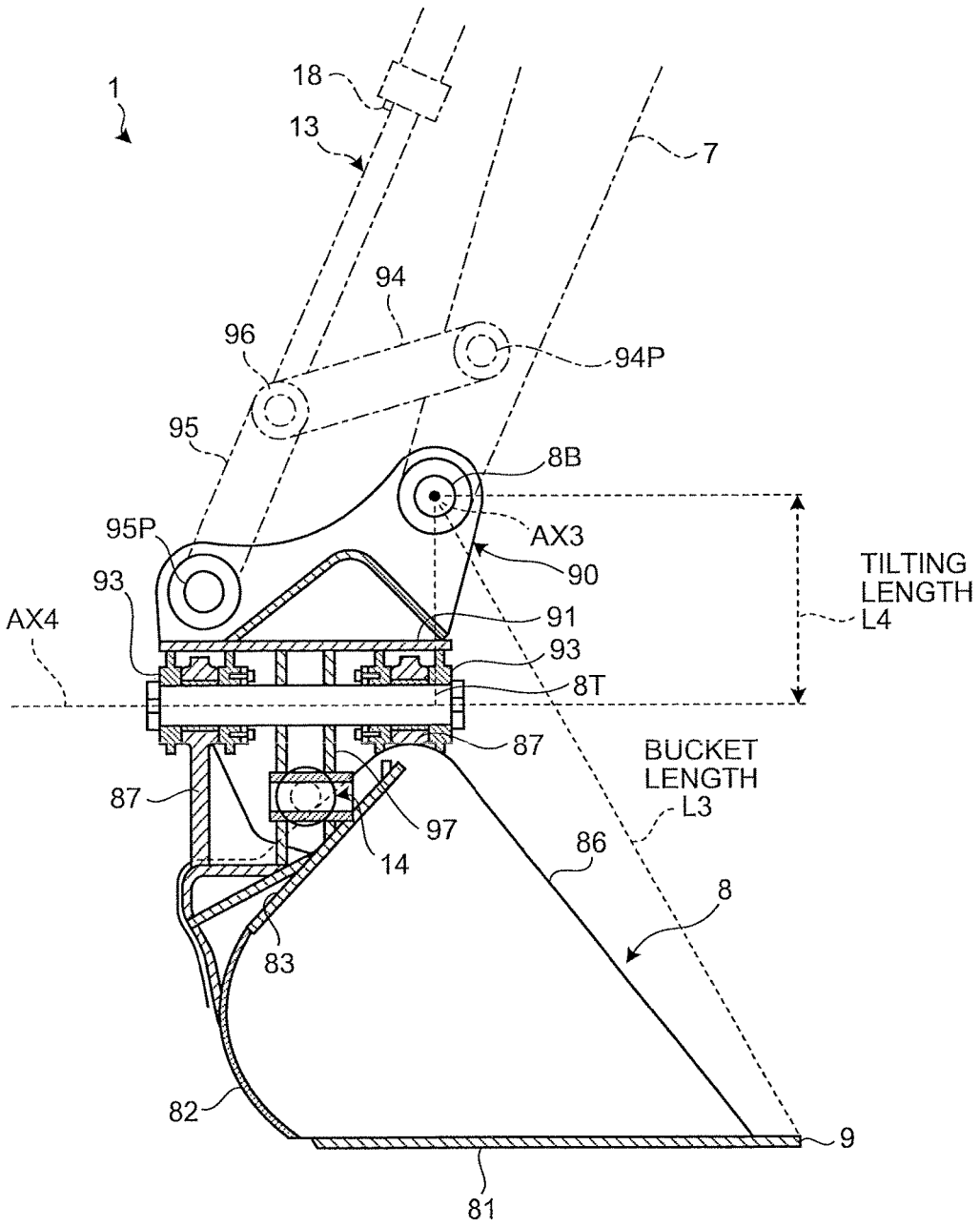
FIG. 2 is a side cross-sectional view illustrating an example of a bucket according to the embodiment.
Figure 3:
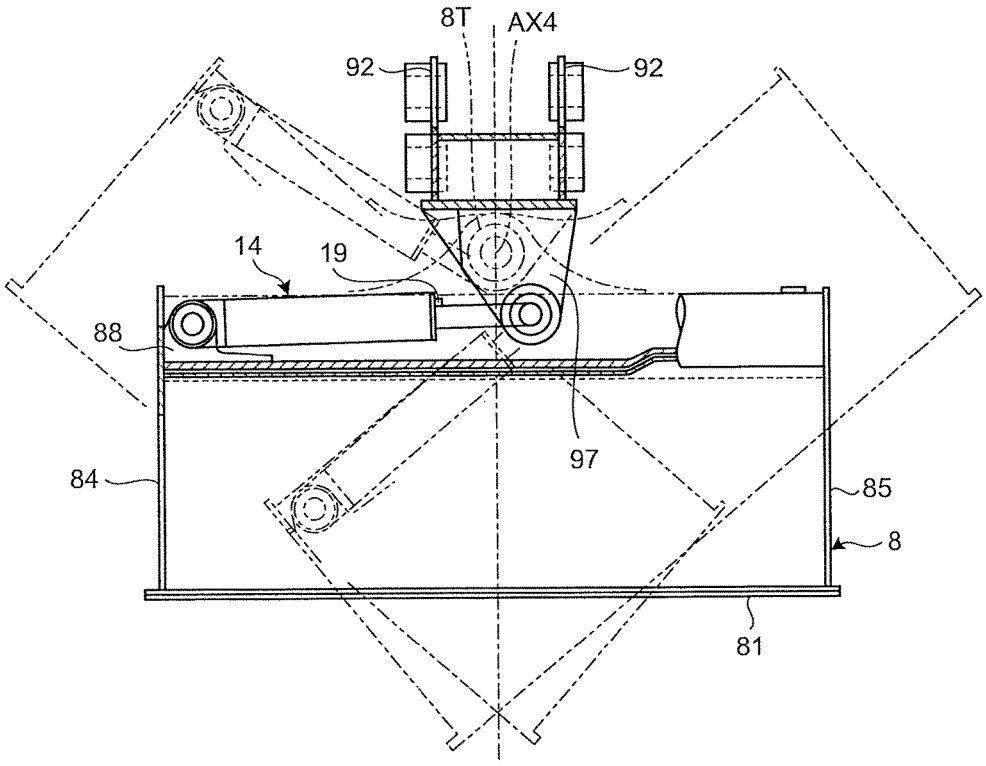
FIG. 3 is a front view illustrating an example of the bucket according to the embodiment.

Next, the bucket 8 according to the embodiment will be described. FIG. 2 is a side cross-sectional view illustrating an example of the bucket 8 according to the embodiment. FIG. 3 is a front view illustrating an example of the bucket 8 according to the embodiment. In the embodiment, the bucket 8 is a tilting type bucket.

As illustrated in FIGS. 2 and 3, the working device 1 includes the bucket 8 which is rotatable about the bucket axis AX3 and the tilting axis AX4 orthogonal to the bucket axis AX3 with respect to the arm 7. The bucket 8 is rotatably connected to the arm 7 through a bucket pin 8B. Further, the bucket 8 is rotatably supported by the arm 7 through a tilting pin 8T.

The bucket 8 is connected to a front end portion of the arm 7 through a connection member 90. The bucket pin 8B connects the arm 7 and the connection member 90 to each other. The tilting pin 8T connects the connection member 90 and the bucket 8 to each other. The bucket 8 is rotatably connected to the arm 7 through the connection member 90.

The bucket 8 includes a bottom plate 81, a rear plate 82, an upper plate 83, a side plate 84, and a side plate 85. The bucket 8 includes a bracket 87 which is provided at an upper portion of the upper plate 83. The bracket 87 is provided at the front and rear positions of the upper plate 83. The bracket 87 is connected to the connection member 90 and the tilting pin 8T.

The connection member 90 includes a plate member 91, a bracket 92 which is provided at an upper face of the plate member 91, and a bracket 93 which is provided at a lower face of the plate member 91. The bracket 92 is connected to the arm 7 and a second link pin 95P. The bracket 93 is provided at an upper portion of the bracket 87 and is connected to the tilting pin 8T and the bracket 87.

The bucket pin 8B connects the bracket 92 of the connection member 90 to the front end portion of the arm 7. The tilting pin 8T connects the bracket 93 of the connection member 90 to the bracket 87 of the bucket 8. The connection member 90 and the bucket 8 are rotatable about the bucket axis AX3 with respect to the arm 7. The bucket 8 is rotatable about the tilting axis AX4 with respect to the connection member 90.

The working device 1 includes a first link member 94 that is rotatably connected to the arm 7 through a first link pin 94P and a second link member 95 that is rotatably connected to the bracket 92 through the second link pin 95P. A base end portion of the first link member 94 is connected to the arm 7 through the first link pin 94P. A base end portion of the second link member 95 is connected to the bracket 92 through the second link pin 95P. A front end portion of the first link member 94 and a front end portion of the second link member 95 are connected to each other through a bucket cylinder top pin 96.

A front end portion of the bucket cylinder 13 is rotatably connected to the front end portion of the first link member 94 and the front end portion of the second link member 95 through the bucket cylinder top pin 96. When the bucket cylinder 13 is operated in a telescopic manner, the connection member 90 rotates about the bucket axis AX3 along with the bucket 8.

The tilting cylinder 14 is connected to each of a bracket 97 provided at the connection member 90 and a bracket 88 provided at the bucket 8. A rod of the tilting cylinder 14 is connected to the bracket 97 through a pin. A body of the tilting cylinder 14 is connected to the bracket 88 through a pin. When the tilting cylinder 14 is operated in a telescopic manner, the bucket 8 rotates about the tilting axis AX4. Furthermore, the connection structure of the tilting cylinder 14 according to the embodiment is merely an example and is not limited thereto.

In this way, the bucket 8 rotates about the bucket axis AX3 by the operation of the bucket cylinder 13. The bucket 8 rotates about the tilting axis AX4 by the operation of the tilting cylinder 14. When the bucket 8 rotates about the bucket axis AX3, the tilting pin 8T rotates along with the bucket 8.

[Detection System]

Figure 4:
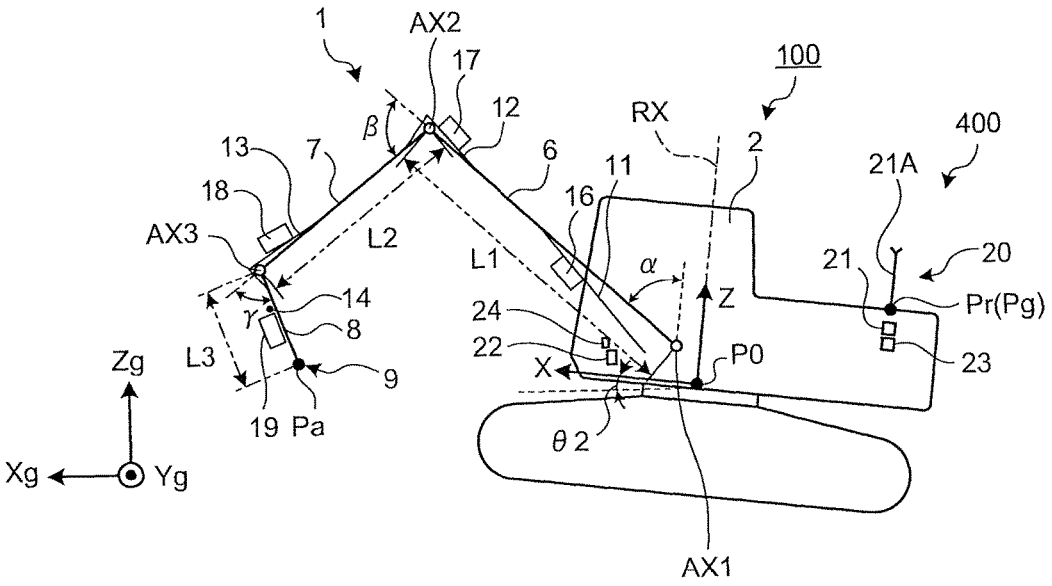
FIG. 4 is a side view schematically illustrating an excavator according to the embodiment.
Figure 5:
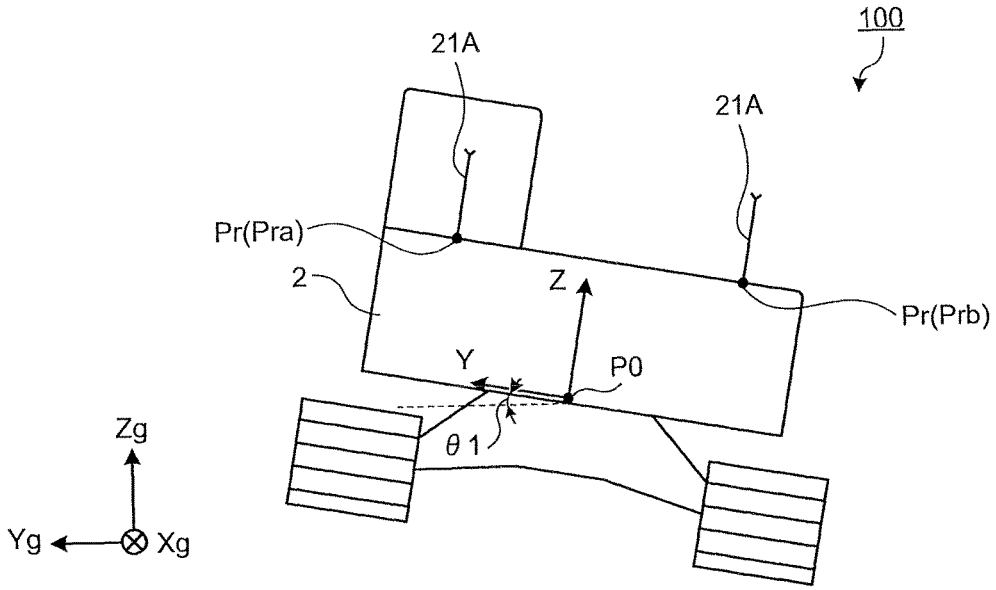
FIG. 5 is a rear view schematically illustrating the excavator according to the embodiment.
Figure 6:
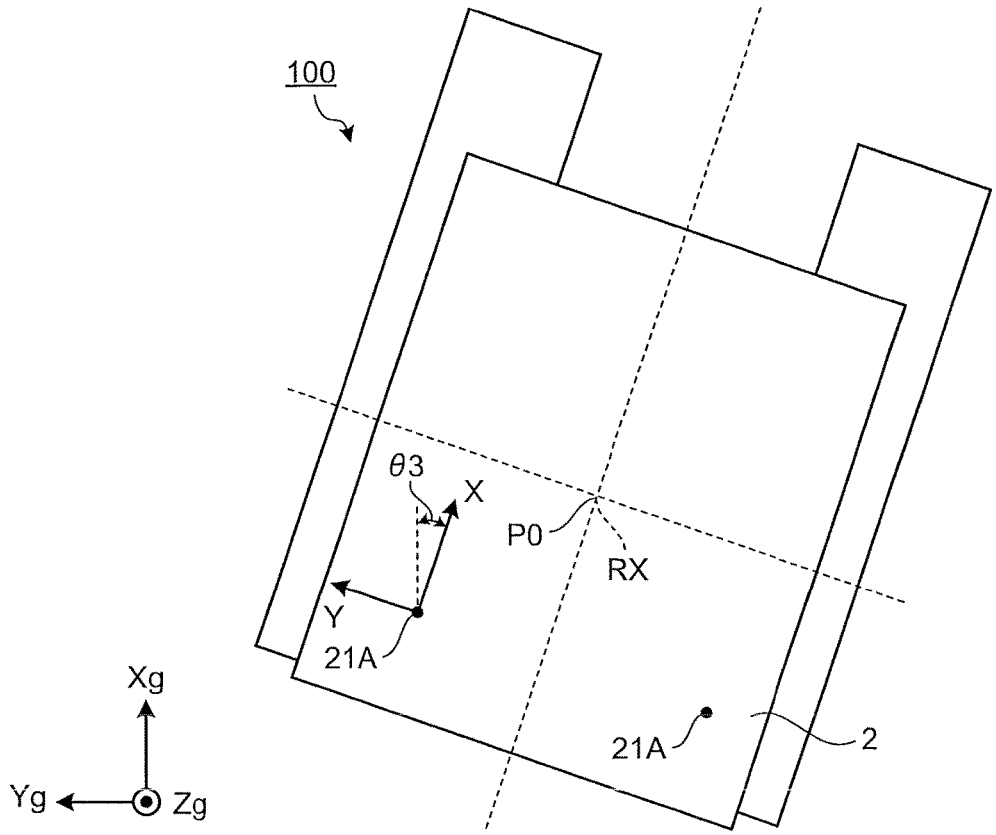
FIG. 6 is a top view schematically illustrating the excavator according to the embodiment.
Figure 7:
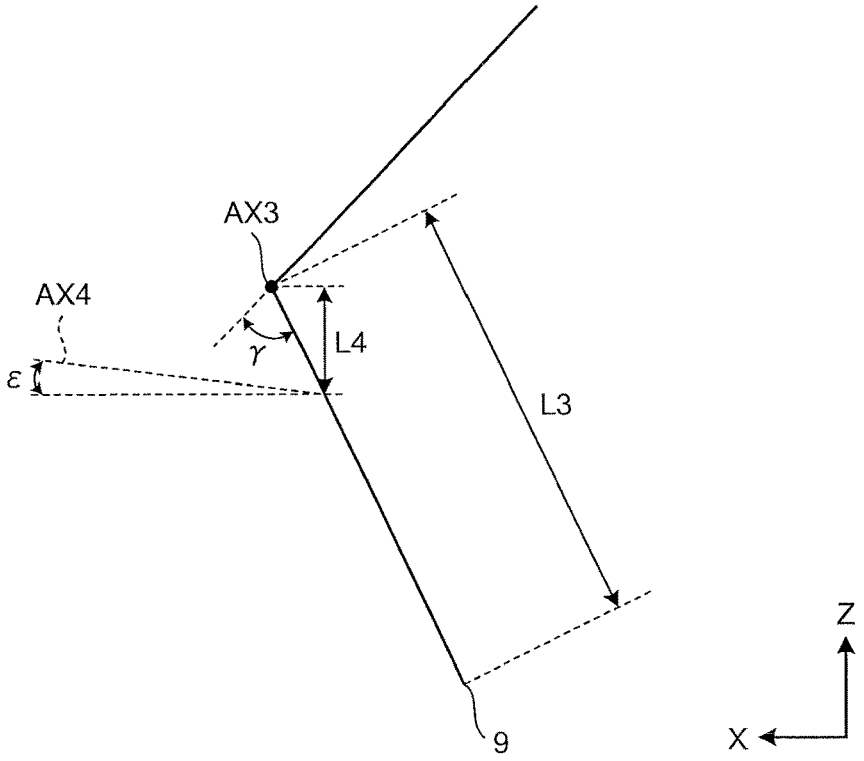
FIG. 7 is a side view schematically illustrating the bucket according to the embodiment.
Figure 8:
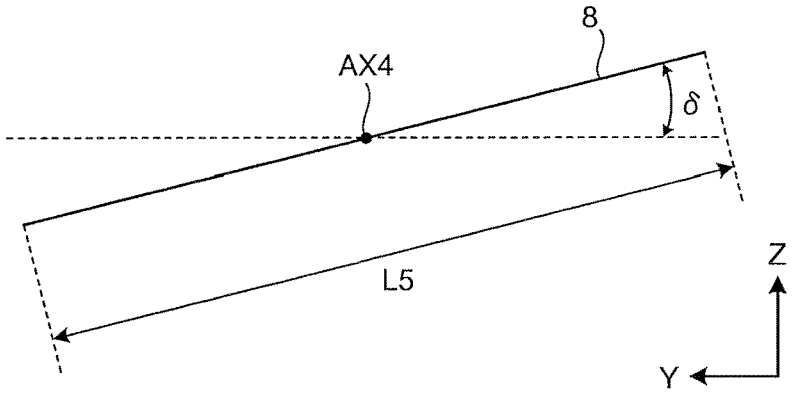
FIG. 8 is a front view schematically illustrating the bucket according to the embodiment.

Next, a detection system 400 of the excavator 100 according to the embodiment will be described. FIG. 4 is a side view schematically illustrating the excavator 100 according to the embodiment. FIG. 5 is a rear view schematically illustrating the excavator 100 according to the embodiment. FIG. 6 is a top view schematically illustrating the excavator 100 according to the embodiment. FIG. 7 is a side view schematically illustrating the bucket 8 according to the embodiment. FIG. 8 is a front view schematically illustrating the bucket 8 according to the embodiment.

As illustrated in FIGS. 4, 5, and 6, the detection system 400 includes a position calculation device 20 which calculates a position of the upper swinging body 2 and a working device angle calculation device 24 which calculates an angle of the working device 1.

The position calculation device 20 includes a vehicle body position calculator 21 which detects a position of the upper swinging body 2, a posture calculator 22 which detects a posture of the upper swinging body 2, and an orientation calculator 23 which detects an orientation of the upper swinging body 2.

The vehicle body position calculator 21 includes a GPS receiver. The vehicle body position calculator 21 is provided at the upper swinging body 2. The vehicle body position calculator 21 detects an absolute position Pg of the upper swinging body 2 defined by the global coordinate system. The absolute position Pg of the upper swinging body 2 includes coordinate data in an Xg axis direction, coordinate data in a Yg axis direction, and coordinate data in a Zg axis direction.

The upper swinging body 2 is provided with a plurality of GPS antennas 21A. The GPS antenna 21A receives a radio wave from a GPS satellite and outputs a signal generated based on the received radio wave to the vehicle body position calculator 21. The vehicle body position calculator 21 detects an installation position Pr of the GPS antenna 21A defined by the global coordinate system based on a signal supplied from the GPS antenna 21A. The vehicle body position calculator 21 detects the absolute position Pg of the upper swinging body 2 based on the installation position Pr of the GPS antenna 21A.

Two GPS antennas 21A are provided in the vehicle width direction. The vehicle body position calculator 21 detects each of an installation position Pra of one GPS antenna 21A and an installation position Prb of the other GPS antenna 21A. The vehicle body position calculator 21A performs a calculation process based on at least one of the position Pra and the position Prb to calculate the absolute position Pg of the upper swinging body 2. In the embodiment, the absolute position Pg of the upper swinging body 2 is the position Pra. Furthermore, the absolute position Pg of the upper swinging body 2 may be the position Prb or a position between the position Pra and the position Prb.

The posture calculator 22 includes an Inertial Measurement Unit (IMU). The posture calculator 22 is provided at the upper swinging body 2. The posture calculator 22 calculates an inclination angle of the upper swinging body 2 with respect to a horizontal plane (an XgYg plane) defined by the global coordinate system. The inclination angle of the upper swinging body 2 with respect to the horizontal plane includes a roll angle θ1 which indicates the inclination angle of the upper swinging body 2 in the vehicle width direction and a pitch angle θ2 which indicates the inclination angle of the upper swinging body 2 in the anteroposterior direction.

The orientation calculator 23 calculates the orientation of the upper swinging body 2 with respect to a reference orientation defined by the global coordinate system based on the installation position Pra of one GPS antenna 21A and the installation position Prb of the other GPS antenna 21A. The reference orientation is, for example, a north. The orientation calculator 23 calculates the orientation of the upper swinging body 2 with respect to the reference orientation by performing a calculation process based on the position Pra and the position Prb. The orientation calculator 23 calculates a line connecting the position Pra and the position Prb and calculates the orientation of the upper swinging body 2 with respect to the reference orientation based an angle formed by the calculated line and the reference orientation. The orientation of the upper swinging body 2 with respect to the reference orientation includes a yaw angle θ3 which is an angle formed by the reference orientation and the orientation of the upper swinging body 2.

As illustrated in FIGS. 4, 7, and 8, the working device angle calculation device 24 calculates a boom angle α which indicates an inclination angle of the boom 6 with respect to the Z axis of the local coordinate system based on the boom stroke detected by the boom stroke sensor 16. The working device angle calculation device 24 calculates an arm angle β which indicates an inclination angle of the arm 7 with respect to the boom 6 based on the arm stroke detected by the arm stroke sensor 17. The working device angle calculation device 24 calculates a bucket angle γ which indicates an inclination angle of the tip 9 of the bucket 8 with respect to the arm 7 based on the bucket stroke detected by the bucket stroke sensor 18. The working device angle calculation device 24 calculates a tilting angle δ which indicates an inclination angle of the bucket 8 with respect to the XY plane based on the tilting stroke detected by the tilting stroke sensor 19. The working device angle calculation device 24 calculates a tilting axis angle ε which indicates an inclination angle of the tilting axis AX4 with respect to the XY plane based on the boom stroke detected by the boom stroke sensor 16, the arm stroke detected by the arm stroke sensor 17, and the tilting stroke detected by the bucket stroke sensor 18.

Furthermore, the boom angle α, the arm angle β, the bucket angle γ, the tilting angle δ, and the tilting axis angle ε may be detected by, for example, angle sensors which are provided in the working device 10 instead of the stroke sensors. Further, an angle of the working device 10 may be optically detected by a stereo camera or a laser scanner and the boom angle α, the arm angle β, the bucket angle γ, the tilting angle δ, and the tilting axis angle ε may be calculated by using the detection result.

[Hydraulic System]

Figure 9:
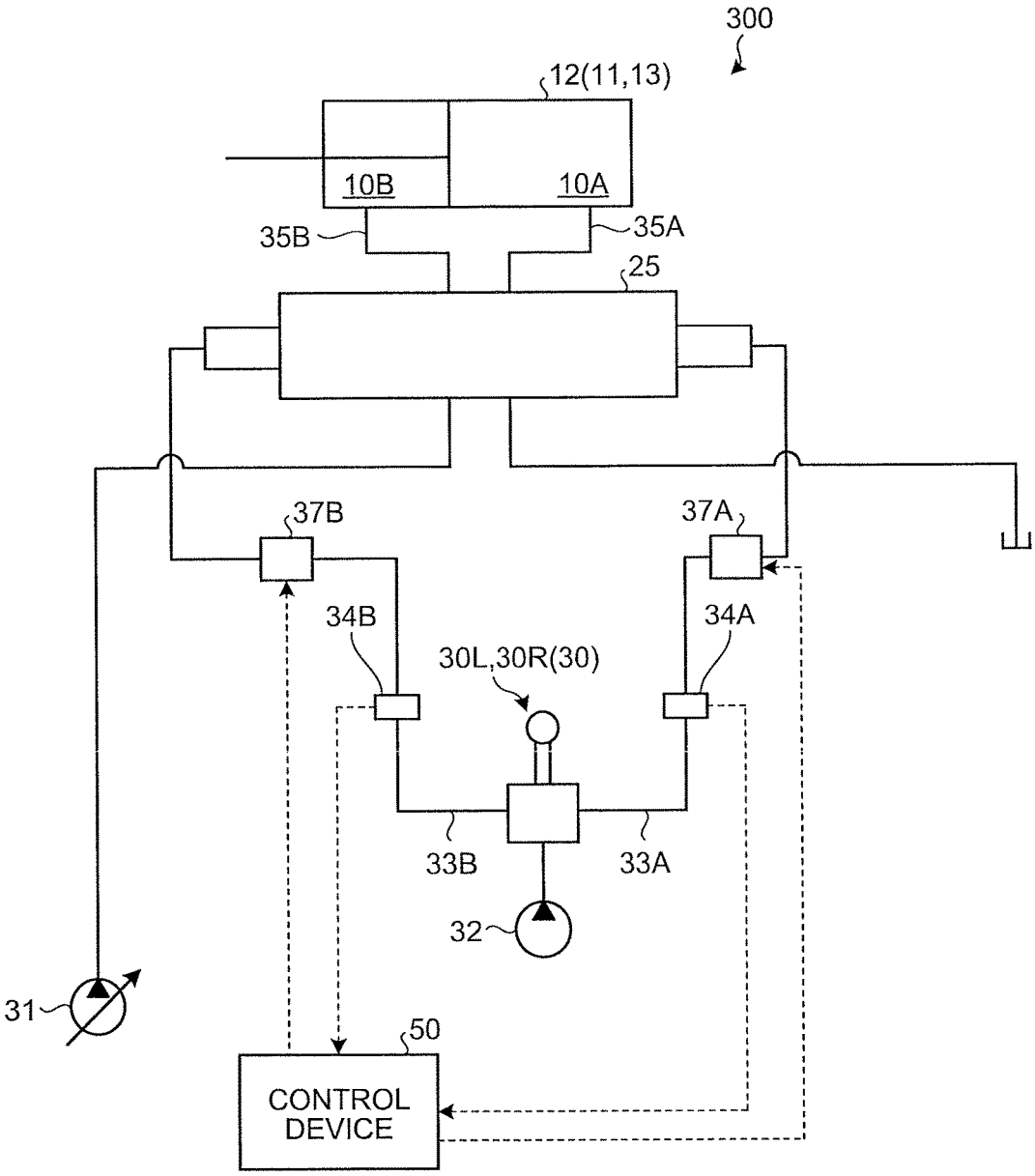
FIG. 9 is a schematic diagram illustrating an example of a hydraulic system according to the embodiment.
Figure 10:
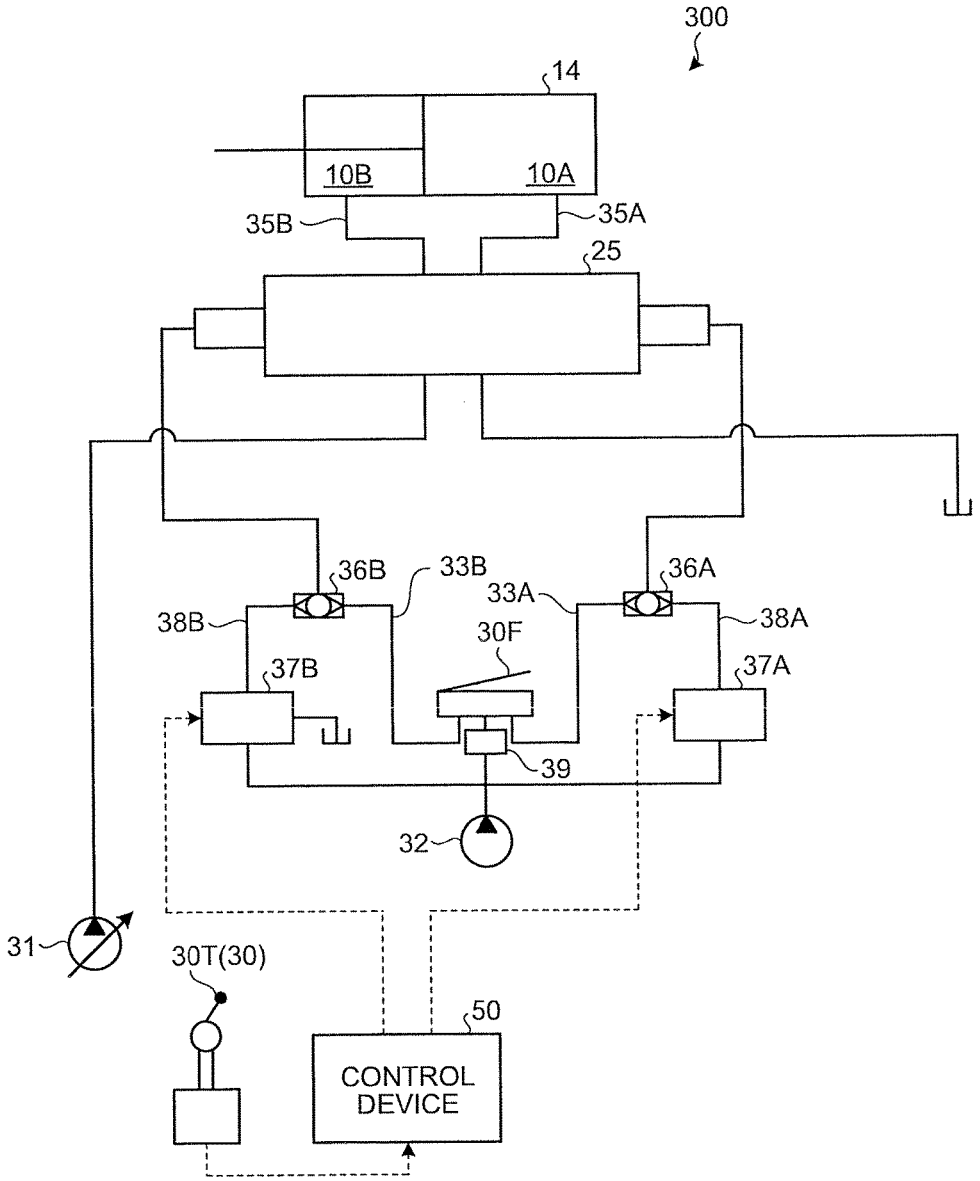
FIG. 10 is a schematic diagram illustrating an example of the hydraulic system according to the embodiment.

Next, a hydraulic system 300 of the excavator 100 according to the embodiment will be described. FIGS. 9 and 10 are schematic diagrams illustrating an example of the hydraulic system 300 according to the embodiment. The hydraulic cylinder 10 which includes the boom cylinder 11, the arm cylinder 12, the bucket cylinder 13, and the tilting cylinder 14 is driven by the hydraulic system 300. The hydraulic system 300 supplies hydraulic oil to the hydraulic cylinder 10 to drive the hydraulic cylinder 10. The hydraulic system 300 includes a flow rate control valve 25. The flow rate control valve 25 controls a hydraulic oil supply amount and a hydraulic oil flow direction with respect to the hydraulic cylinder 10. The hydraulic cylinder 10 includes a cap side oil chamber 10A and a rod side oil chamber 10B. The cap side oil chamber 10A is a space between a cylinder head cover and a piston. The rod side oil chamber 10B is a space where the piston rod is disposed. When the hydraulic oil is supplied to the cap side oil chamber 10A through an oil passage 35A, the hydraulic cylinder 10 is lengthened. When the hydraulic oil is supplied to the rod side oil chamber 10B through an oil passage 35B, the hydraulic cylinder 10 is shortened.

FIG. 9 is a schematic diagram illustrating an example of the hydraulic system 300 that operates the arm cylinder 12. The hydraulic system 300 includes a variable displacement type main hydraulic pump 31 which supplies the hydraulic oil, a pilot pressure pump 32 which supplies the pilot oil, oil passages 33A and 33B through which the pilot oil flows, pressure sensors 34A and 34B which are disposed at the oil passages 33A and 33B, control valves 37A and 37B which adjust the pilot pressure acting on the flow rate control valve 25, the manipulation device 30 which includes the right working device manipulation lever 30R and the left working device manipulation lever 30L used to adjust the pilot pressure for the flow rate control valve 25, and the control device 50. The right working device manipulation lever 30R and the left working device manipulation lever 30L of the manipulation device 30 are pilot hydraulic type manipulation devices.

The hydraulic oil which is supplied from the main hydraulic pump 31 is supplied to the arm cylinder 12 through the direction control valve 25. The flow rate control valve 25 is a slide spool type flow rate control valve which moves a spool in a rod shape in the axis direction to switch a hydraulic oil flow direction. When the spool moves in the axis direction, the supply of the hydraulic oil to the cap side oil chamber 10A of the arm cylinder 12 and the supply of the hydraulic oil to the rod side oil chamber 10B are switched. Further, when the spool moves in the axis direction, the hydraulic oil supply amount per unit time for the arm cylinder 12 is adjusted. When the hydraulic oil supply amount for the arm cylinder 12 is adjusted, a cylinder speed is adjusted.

The flow rate control valve 25 is manipulated by the manipulation device 30. The pilot oil which is fed from the pilot pressure pump 32 is supplied to the manipulation device 30. Furthermore, the pilot oil which is fed from the main hydraulic pump 31 and is decreased in pressure by the pressure reduction valve may be supplied to the manipulation device 30. The manipulation device 30 includes a pilot pressure adjustment valve. The control valves 37A and 37B are operated based on the manipulation amount of the manipulation device 30 so that the pilot pressure acting on the spool of the flow rate control valve 25 is adjusted. The flow rate control valve 25 is driven by the pilot pressure. When the pilot pressure is adjusted by the manipulation device 30, the movement amount, the movement speed, and the movement direction of the spool in the axis direction are adjusted.

The flow rate control valve 25 includes a first pressure receiving chamber and a second pressure receiving chamber. When the left working device manipulation lever 30L is manipulated to be inclined toward one side from the neutral position so that the spool is moved by the pilot pressure of the oil passage 33A, the hydraulic oil is supplied from the main hydraulic pump 31 to the first pressure receiving chamber and the hydraulic oil is supplied to the cap side oil chamber 10A through the oil passage 35A. When the left working device manipulation lever 30L is manipulated to be inclined toward the other side from the neutral position so that the spool is moved by the pilot pressure of the oil passage 33B, the hydraulic oil is supplied from the main hydraulic pump 31 to the second pressure receiving chamber and the hydraulic oil is supplied to the rod side oil chamber 10B through the oil passage 35B.

The pressure sensor 34A detects the pilot pressure of the oil passage 33A. The pressure sensor 34B detects the pilot pressure of the oil passage 33B. The detection signals of the pressure sensors 33A and 33B are output to the control device 50. When the working device control is performed, the control device 50 adjusts the pilot pressure by outputting a control signal to the control valves 37A and 37B.

The hydraulic system 300 which operates the boom cylinder 11 and the bucket cylinder 13 has the same configuration as that of the hydraulic system 300 operating the arm cylinder 12. A detailed description of the hydraulic system 300 operating the boom cylinder 11 and the bucket cylinder 13 will be omitted. Furthermore, in order to perform the working device control on the boom 6, an intervention control valve which is used to raise the boom 6 may be connected to the oil passage 33A connected to the boom cylinder 11.

Furthermore, the right working device manipulation lever 30R and the left working device manipulation lever 30L of the manipulation device 30 may not be of the pilot hydraulic type. The right working device manipulation lever 30R and the left working device manipulation lever 30L may be of an electronic lever type in which an electric signal is output to the control device 50 based on the manipulation amounts (the inclination angles) of the right working device manipulation lever 30R and the left working device manipulation lever 30L and the flow rate control valve 25 is directly controlled based on the control signal of the control device 50.

FIG. 10 is a diagram schematically illustrating an example of the hydraulic system 300 that operates the tilting cylinder 14. The hydraulic system 300 includes the flow rate control valve 25 which adjusts the hydraulic oil supply amount for the tilting cylinder 14, the control valves 37A and 37B which adjust the pilot pressure acting on the flow rate control valve 25, a control valve 39 which is disposed between the pilot pressure pump 32 and the manipulation pedal 30F, the tilting manipulation lever 30T and the manipulation pedal 30F of the manipulation device 30, and the control device 50. In the embodiment, the manipulation pedal 30F of the manipulation device 30 is a pilot hydraulic type manipulation device. The tilting manipulation lever 30T of the manipulation device 30 is an electronic lever type manipulation device. The tilting manipulation lever 30T includes a manipulation button provided at each of the right working device manipulation lever 30R and the left working device manipulation lever 30L.

The manipulation pedal 30F of the manipulation device 30 is connected to the pilot pressure pump 32. Further, the manipulation pedal 30F is connected to an oil passage 38A in which the pilot oil fed from the control valve 37A flows through a shuttle valve 36A. Further, the manipulation pedal 30F is connected to an oil passage 38B in which the pilot oil fed from the control valve 37B flows through a shuttle valve 36B. When the manipulation pedal 30F is manipulated, the pressure of the oil passage 33A between the manipulation pedal 30F and the shuttle valve 36A and the pressure of the oil passage 33B between the manipulation pedal 30F and the shuttle valve 36B are adjusted.

When the tilting manipulation lever 30T is operated, a manipulation signal generated by the manipulation of the tilting manipulation lever 30T is output to the control device 50. The control device 50 generates a control signal based on the manipulation signal output from the tilting manipulation lever 30T to control the control valves 37A and 37B. The control valves 37A and 37B are electromagnetic proportional control valves. The control valve 37A opens or closes the oil passage 38A based on the control signal. The control valve 37B opens or closes the oil passage 38B based on the control signal.

When a tilting bucket control is not performed, the pilot pressure is adjusted based on the manipulation amount of the manipulation device 30. When the tilting bucket control is performed, the control device 50 outputs a control signal to the control valves 37A and 37B to adjust the pilot pressure.

[Control System]

Figure 11:
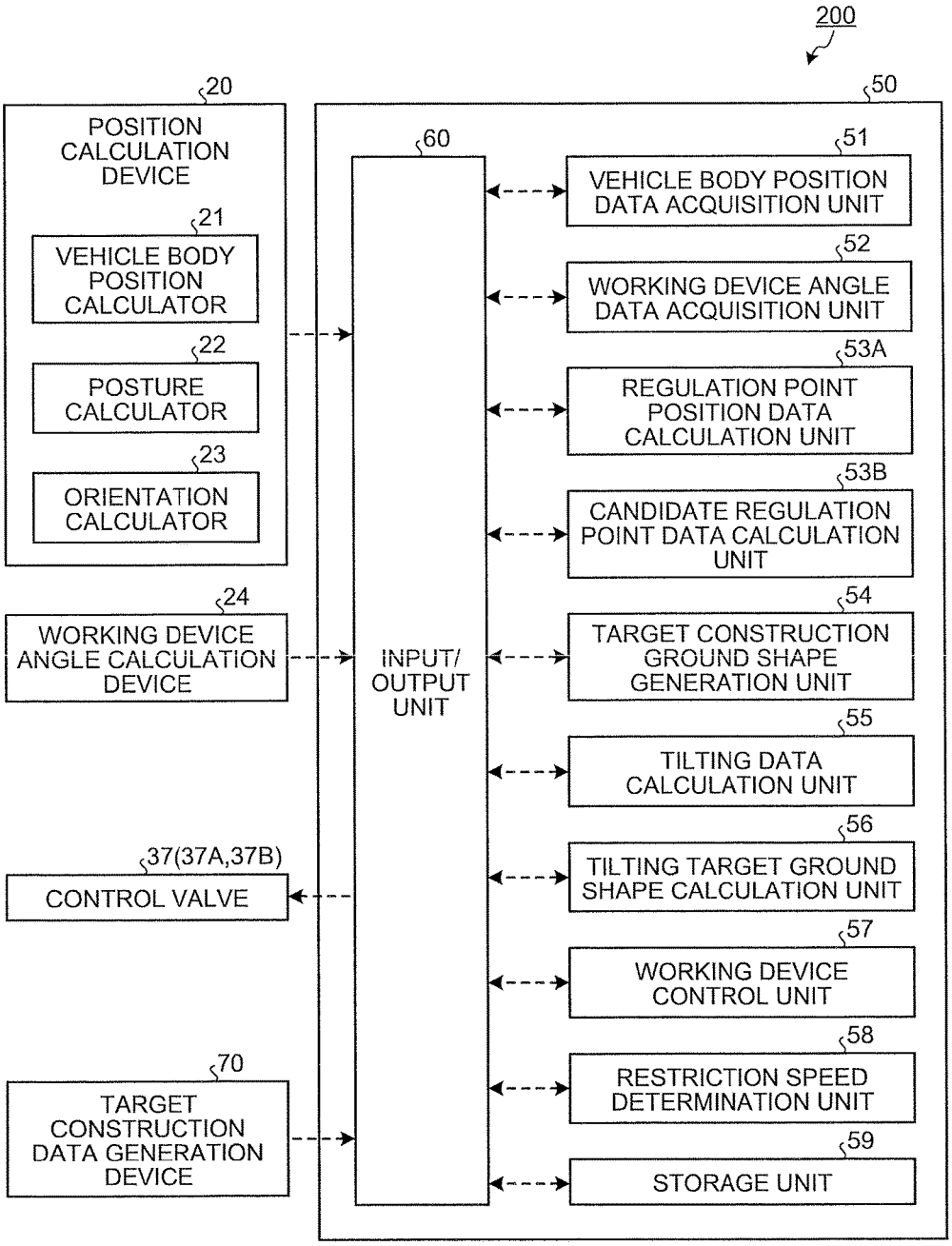
FIG. 11 is a functional block diagram illustrating an example of a control system according to the embodiment.

Next, a control system 200 of the excavator 100 according to the embodiment will be described. FIG. 11 is a functional block diagram illustrating an example of the control system 200 according to the embodiment.

As illustrated in FIG. 11, the control system 200 includes the control device 50 which controls the working device 1, the position calculation device 20, the working device angle calculation device 24, a control valve 37 (37A, 37B), and a target construction data generation device 70.

The position calculation device 20 includes the vehicle body position calculator 21, the posture calculator 22, and the orientation calculator 23. The position calculation device 20 detects the absolute position Pg of the upper swinging body 2, the posture of the upper swinging body 2 including the roll angle θ1 and the pitch angle θ2, and the orientation of the upper swinging body 2 including the yaw angle θ3.

The working device angle calculation device 24 detects the angle of the working device 1 including the boom angle α, the arm angle β, the bucket angle γ, the tilting angle δ, and the tilting axis angle ε.

The control valve 37 (37A, 37B) adjusts the hydraulic oil supply amount for the tilting cylinder 14. The control valve 37 is operated based on the control signal from the control device 50.

The target construction data generation device 70 includes a computing system. The target construction data generation device 70 generates target construction data indicating a target ground shape which is a target shape of a construction area. The target construction data indicates a three-dimensional target shape obtained by a construction using the working device 1.

The target construction data generation device 70 is provided at a remote place separated from the excavator 100. The target construction data generation device 70 is provided at, for example, equipment of a construction management company. The target construction data generation device 70 and the control device 50 can wirelessly communicate with each other. The target construction data generated by the target construction data generation device 70 is wirelessly transmitted to the control device 50.

Furthermore, the target construction data generation device 70 and the control device 50 may be connected to each other by a wire so that the target construction data is transmitted from the target construction data generation device 70 to the control device 50. Furthermore, the target construction data generation device 70 may include a recording medium storing the target construction data and the control device 50 may include a device capable of reading the target construction data from the recording medium.

Furthermore, the target construction data generation device 70 may be provided at the excavator 100. The target construction data may be transmitted from an external management device which manages a construction to the target construction data generation device 70 of the excavator 100 in a wired or wireless manner so that the target construction data generation device 70 stores the target construction data transmitted thereto.

The control device 50 includes a vehicle body position data acquisition unit 51, a working device angle data acquisition unit 52, a regulation point position data calculation unit 53A, a candidate regulation point data calculation unit 53B, a target construction ground shape generation unit 54, a tilting data calculation unit 55, a tilting target ground shape calculation unit 56, a working device control unit 57, a restriction speed determination unit 58, a storage unit 59, and an input/output unit 60.

The functions of the vehicle body position data acquisition unit 51, the working device angle data acquisition unit 52, the regulation point position data calculation unit 53A, the candidate regulation point data calculation unit 53B, the target construction ground shape generation unit 54, the tilting data calculation unit 55, the tilting target ground shape calculation unit 56, the working device control unit 57, and the restriction speed determination unit 58 are exhibited by the processor of the control device 50. The function of the storage unit 59 is realized by the storage device of the control device 50. The function of the input/output unit 60 is realized by an input/output interface device of the control device 50. An input/output unit 63 is connected to the position calculation device 20, the working device angle calculation device 24, the control valve 37, and the target construction data generation device 70 and performs a data communication with respect to the vehicle body position data acquisition unit 51, the working device angle data acquisition unit 52, the regulation point position data calculation unit 53A, the candidate regulation point data calculation unit 53B, the target construction ground shape generation unit 54, the tilting data calculation unit 55, the tilting target ground shape calculation unit 56, the working device control unit 57, the restriction speed determination unit 58, and the storage unit 59.

The storage unit 59 stores specification data of the excavator 100 including working device data.

The vehicle body position data acquisition unit 51 acquires vehicle body position data from the position calculation device 20 via the input/output unit 60. The vehicle body position data includes the absolute position Pg of the upper swinging body 2 defined by the global coordinate system, the posture of the upper swinging body 2 including the roll angle θ1 and the pitch angle θ2, and the orientation of the upper swinging body 2 including the yaw angle θ3.

The working device angle data acquisition unit 52 acquires working device angle data from the working device angle calculation device 24 via the input/output unit 60. The working device angle data is used to detect the angle of the working device 1 including the boom angle α, the arm angle β, the bucket angle γ, the tilting angle δ, and the tilting axis angle ε.

The regulation point position data calculation unit 53A calculates position data of a regulation point RP set in the bucket 8 based on a target construction ground shape, width data of the bucket 8, and outer face data of the bucket 8. A regulation point position data calculation unit 53 calculates the position data of the regulation point RP set in the bucket 8 based on the vehicle body position data acquired by the vehicle body position data acquisition unit 51, the working device angle data acquired by the working device angle data acquisition unit 52, and the working device data stored in the storage unit 59.

As illustrated in FIG. 4, the working device data includes a boom length L1, an arm length L2, a bucket length L3, a tilting length L4, and a bucket width L5. The boom length L1 is a distance between the boom axis AX1 and the arm axis AX2. The arm length L2 is a distance between the arm axis AX2 and the bucket axis AX3. The bucket length L3 is a distance between the bucket axis AX3 and the tip 9 of the bucket 8. The tilting length L4 is a distance between the bucket axis AX3 and the tilting axis AX4. The bucket width L5 is a distance between the side plate 84 and the side plate 85.

Figure 12:
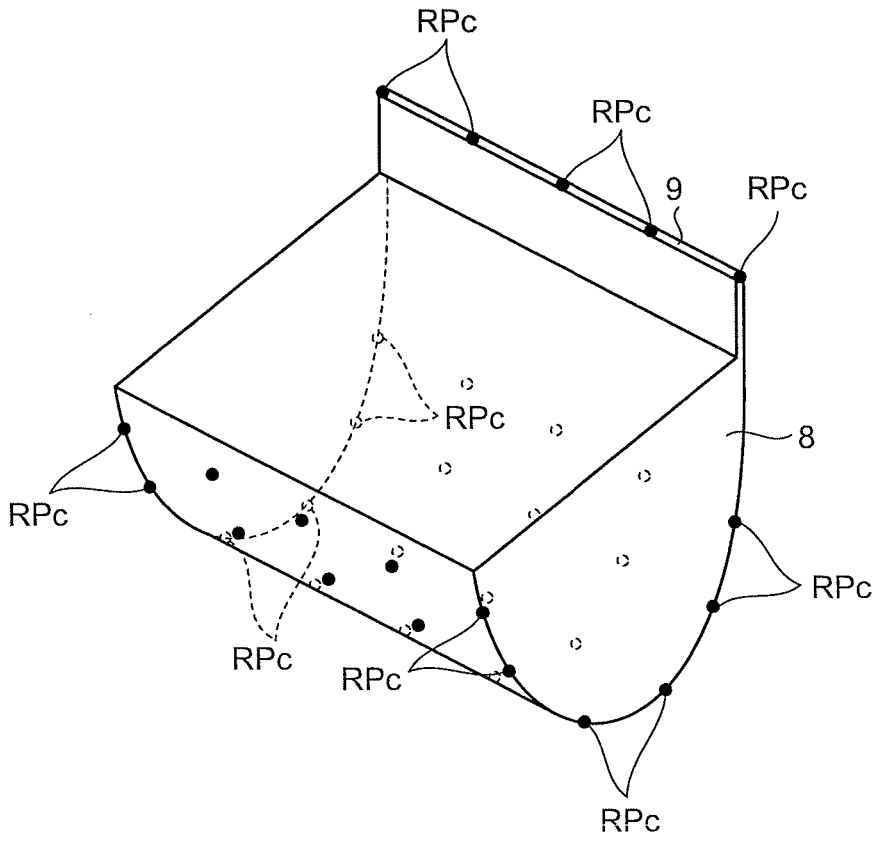
FIG. 12 is a diagram schematically illustrating an example of a regulation point set in the bucket according to the embodiment.

FIG. 12 is a diagram schematically illustrating an example of the regulation point RP set in the bucket 8 according to the embodiment. As illustrated in FIG. 12, a plurality of candidate regulation points RPc which are candidates of the regulation point RP used in the tilting bucket control are set in the bucket 8. The candidate regulation point RPc is set at the tip 9 of the bucket 8 and the outer face of the bucket 8. The plurality of candidate regulation points RPc are set in the tip 9 in a bucket width direction. Further, the plurality of candidate regulation points RPc are set in the outer face of the bucket 8.

Further, the working device data includes bucket external shape data indicating a shape and a dimension of the bucket 8. The bucket external shape data includes width data of the bucket 8 indicating the bucket width L5. Further, the bucket external shape data includes the outer face data of the bucket 8 including outline data of the outer face of the bucket 8. Further, the bucket external shape data includes coordinate data of the plurality of candidate regulation points RPc of the bucket 8 based on the tip 9 of the bucket 8.

The candidate regulation point data calculation unit 53B calculates position data of the plurality of candidate regulation points RPc which are candidates of the regulation point RP. The candidate regulation point data calculation unit 53B calculates the relative positions of the plurality of candidate regulation points RPc with respect to a reference position P0 of the upper swinging body 2. Further, the regulation point position data calculation unit 53 calculates the absolute positions of the plurality of candidate regulation points RPc.

The candidate regulation point data calculation unit 53B can calculate the relative positions of the plurality of candidate regulation points RPc of the bucket 8 with respect to the reference position P0 of the upper swinging body 2 based on the working device data including the boom length L1, the arm length L2, the bucket length L3, the tilting length L4, and the bucket external shape data and the working device angle data including the boom angle α, the arm angle β, the bucket angle γ, the tilting angle δ, and the tilting axis angle ε. As illustrated in FIG. 4, the reference position P0 of the upper swinging body 2 is set in the swing axis RX of the upper swinging body 2. Furthermore, the reference position P0 of the upper swinging body 2 may be set in the boom axis AX1.

Further, the candidate regulation point data calculation unit 53B can calculate the absolute position Pa of the bucket 8 based on the relative position of the bucket 8 with respect to the reference position P0 of the upper swinging body 2 and the absolute position Pg of the upper swinging body 2 detected by the position calculation device 20. The relative position between the absolute position Pg and the reference position P0 is given data derived from the specification data of the excavator 100. The candidate regulation point data calculation unit 53B can calculate the absolute positions of the plurality of candidate regulation points RPc of the bucket 8 based on the vehicle body position data including the absolute position Pg of the upper swinging body 2, the relative position of the bucket 8 with respect to the reference position P0 of the upper swinging body 2, the working device data, and the working device angle data.

Furthermore, the candidate regulation point RPc is not limited to a point as long as the width data of the bucket 8 and the outer face data of the bucket 8 are included in the point.

The target construction ground shape generation unit 54 generates a target construction ground shape CS which indicates the target shape of the excavation target based on the target construction data supplied from the target construction data generation device 70 and stored in a storage unit 62. The target construction data generation device 70 may supply three-dimensional target ground shape data which is target construction data to the target construction ground shape generation unit 54 and may supply a plurality of pieces of line data or point data indicating a part of the target shape to the target construction ground shape generation unit 54. In the embodiment, it is assumed that the target construction data generation device 70 supplies line data indicating a part of the target shape as the target construction data to the target construction ground shape generation unit 54.

Figure 13:
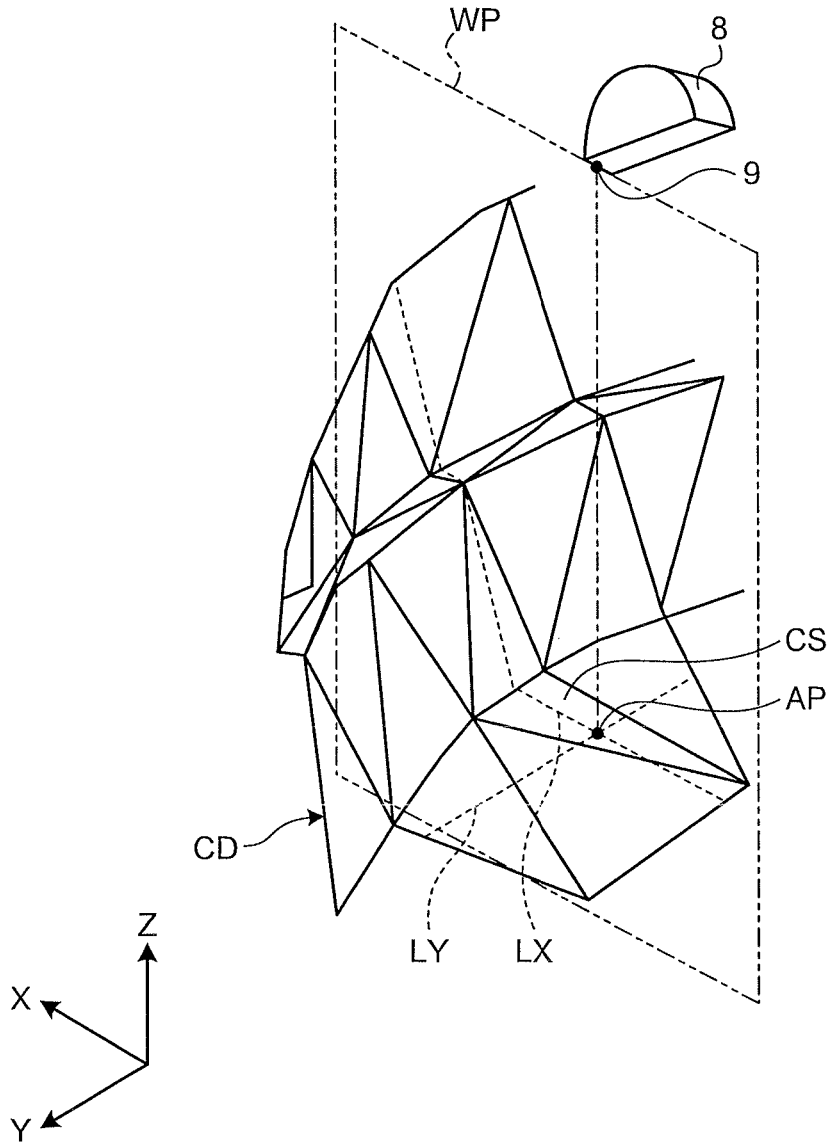
FIG. 13 is a schematic diagram illustrating an example of target construction data according to the embodiment.

FIG. 13 is a schematic diagram illustrating an example of target construction data CD according to the embodiment. As illustrated in FIG. 13, the target construction data CD indicates a target ground shape of a construction area. The target ground shape includes a plurality of target construction ground shapes CS expressed by a triangular polygon. Each of the plurality of target construction ground shapes CS indicates the target shape of the excavation target in the working device 1. In the target construction data CD, a point AP having the closest perpendicular distance with respect to the bucket 8 in the target construction ground shape CS is defined. Further, in the target construction data CD, a working device operation plane WP which is orthogonal to the bucket axis AX3 along the point AP and the bucket 8 is defined. The working device operation plane WP is an operation plane in which the tip 9 of the bucket 8 moves by the operation of at least one of the boom cylinder 11, the arm cylinder 12, and the bucket cylinder 13 and is parallel to the XZ plane. The regulation point position data calculation unit 53A calculates the position data of the regulation point RP defined at a position having the closest perpendicular distance with respect to the point AP of the target construction ground shape CS based on the target construction ground shape CS and the external shape data of the bucket 8. When the regulation point RP is obtained, data involving with at least the width of the bucket 8 may be used. Further, the regulation point RP may be defined by the operator.

The target construction ground shape generation unit 54 acquires a line LX which is an intersection line between the working device operation plane WP and the target construction ground shape CS. Further, the target construction ground shape generation unit 54 acquires a line LY which is orthogonal to the line LX in the target construction ground shape CS along the point AP. The line LY indicates an intersection line between a lateral operation plane VP and the target construction ground shape CS.

Figure 14:
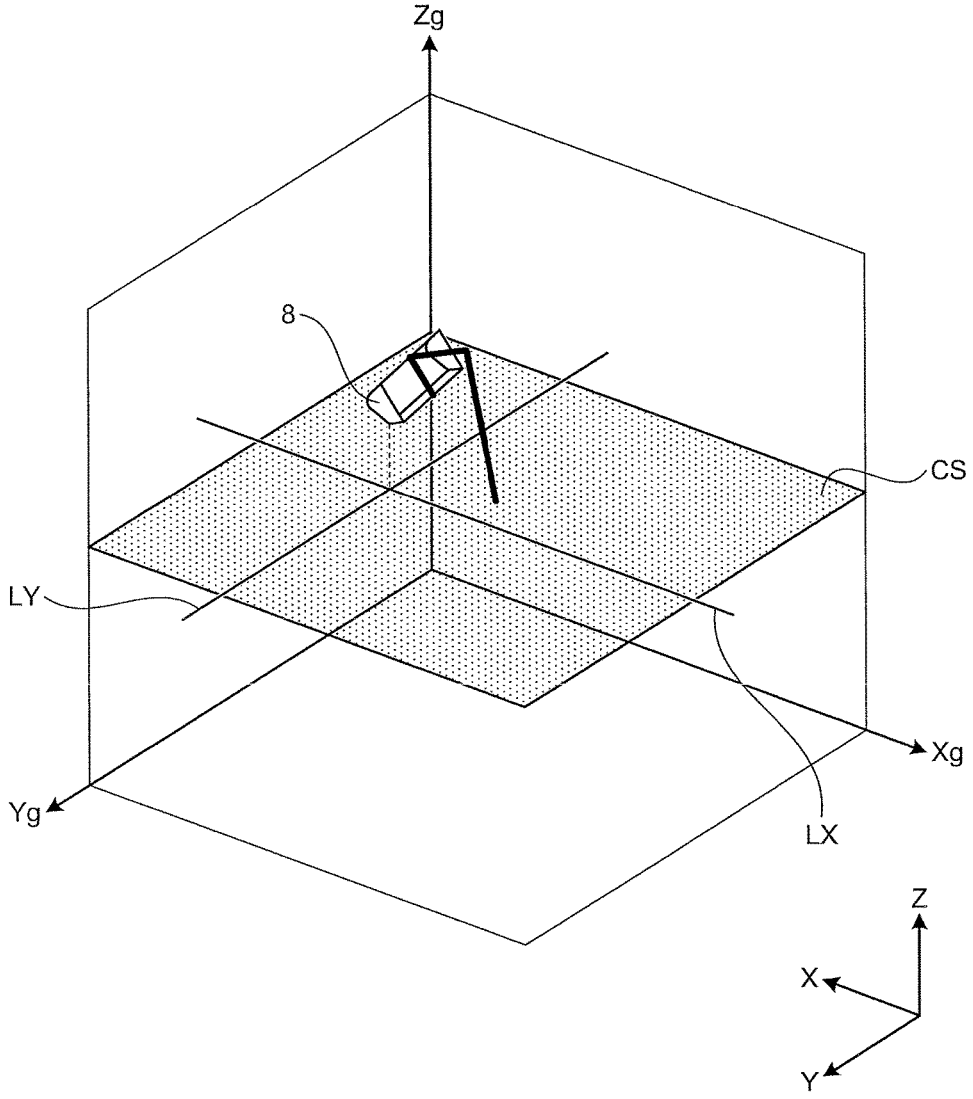
FIG. 14 is a schematic diagram illustrating an example of a target construction ground shape according to the embodiment.

FIG. 14 is a schematic diagram illustrating an example of the target construction ground shape CS according to the embodiment. The target construction ground shape generation unit 54 acquires the line LX and the line LY and generates the target construction ground shape CS indicating the target shape of the excavation target based on the line LX and the line LY. When the target construction ground shape CS is excavated by the bucket 8, the control device 50 moves the bucket 8 along the line LX which is an intersection line between the working device operation plane WP and the target construction ground shape CS and passes through the bucket 8.

The tilting data calculation unit 55 calculates a tilting operation plane TP which is orthogonal to the tilting axis AX4 and passes through the regulation point RP of the bucket 8 as tilting data.

Figure 15:
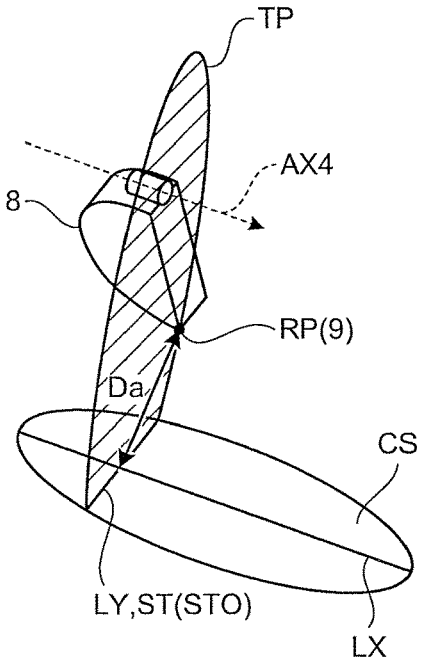
FIG. 15 is a schematic diagram illustrating an example of a tilting operation plane according to the embodiment.
Figure 16:
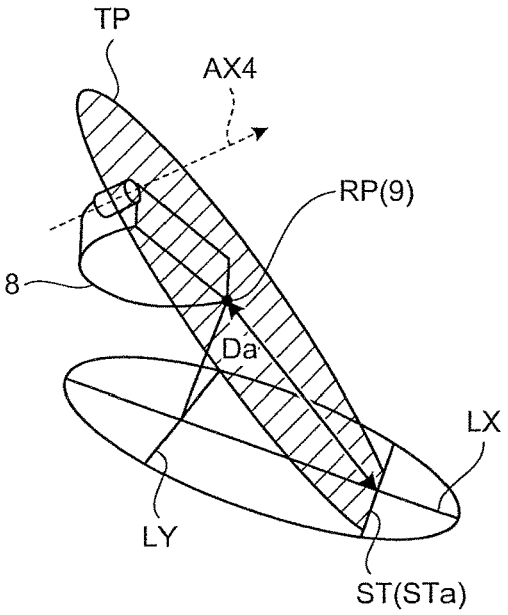
FIG. 16 is a schematic diagram illustrating an example of a tilting operation plane according to the embodiment.

FIGS. 15 and 16 are schematic diagrams illustrating an example of the tilting operation plane TP according to the embodiment. FIG. 15 illustrates the tilting operation plane TP when the tilting axis AX4 is parallel to the target construction ground shape CS. FIG. 16 illustrates the tilting operation plane TP when the tilting axis AX4 is not parallel to the target construction ground shape CS.

As illustrated in FIGS. 15 and 16, the tilting operation plane TP indicates an operation plane which is orthogonal to the tilting axis AX4 and passes through the regulation point RP selected from the plurality of candidate regulation points RPc defined in the bucket 8. The regulation point RP is the regulation point RP which is determined to be most advantageous in the tilting bucket control among the plurality of candidate regulation points RPc. The regulation point RP which is most advantageous in the tilting bucket control is the regulation point RP which is closest to the target construction ground shape CS. Furthermore, the regulation point RP which is most advantageous in the tilting bucket control may be the regulation point RP in which a cylinder speed of the hydraulic cylinder 10 becomes fastest during the tilting bucket control based on the regulation point RP.

FIGS. 15 and 16 illustrate the tilting operation plane TP which passes through the regulation point RP set in the tip 9 as an example. The tilting operation plane TP is an operation plane in which the regulation point RP (the tip 9) of the bucket 8 moves by the operation of the tilting cylinder 14. When the tilting axis angle ε indicating the direction of the tilting axis AX4 changes due to the operation of at least one of the boom cylinder 11, the arm cylinder 12, and the bucket cylinder 13, the inclination of the tilting operation plane TP also changes.

As described above, the working device angle calculation device 24 can calculate the tilting axis angle ε which indicates the inclination angle of the tilting axis AX4 with respect to the XY plane. The tilting axis angle ε is acquired by the working device angle data acquisition unit 52. Further, the position data of the regulation point RP is calculated by the regulation point position data calculation unit 53A. The tilting data calculation unit 55 can calculate the tilting operation plane TP based on the tilting axis angle ε of the tilting axis AX4 acquired by the working device angle data acquisition unit 52 and the position of the regulation point RP calculated by the regulation point position data calculation unit 53A.

The tilting target ground shape calculation unit 56 calculates a tilting target ground shape ST which extends in a lateral direction of the bucket 8 in the target construction ground shape CS based on the position data of the regulation point RP selected from the plurality of candidate regulation points RPc, the target construction ground shape CS, and the tilting data. The tilting target ground shape calculation unit 56 calculates the tilting target ground shape ST defined by an intersection portion between the target construction ground shape CS and the tilting operation plane TP. As illustrated in FIGS. 15 and 16, the tilting target ground shape ST is indicated by an intersection line between the target construction ground shape CS and the tilting operation plane TP. When the tilting axis angle ε which is a direction of the tilting axis AX4 changes, a position of the tilting target ground shape ST changes.

The working device control unit 57 outputs a control signal for controlling the hydraulic cylinder 10. When a tilting stop control is performed, the working device control unit 57 performs the tilting stop control of stopping the tilting of the bucket 8 about the tilting axis AX4 based on an operation distance Da indicating a distance between the regulation point RP of the bucket 8 and the tilting target ground shape ST. That is, in the embodiment, the tilting stop control is performed based on the tilting target ground shape ST. In the tilting stop control, the working device control unit 57 stops the bucket 8 in the tilting target ground shape ST so that the tilting bucket 8 does not exceed the tilting target ground shape ST.

As illustrated in FIG. 15, when the tilting axis AX4 is parallel to the target construction ground shape CS, the tilting target ground shape ST substantially matches the line LY. Thus, the tilting bucket control (the tilting stop control) based on the tilting target ground shape ST is substantially the same as the tilting bucket control (the tilting stop control) based on the line LY.

The working device control unit 57 performs the tilting stop control based on the regulation point RP having the shortest operation distance Da among the plurality of candidate regulation points RPc set in the bucket 8. That is, the working device control unit 57 performs the tilting stop control based on the operation distance Da between the tilting target ground shape ST and the regulation point RP closest to the tilting target ground shape ST so that the regulation point RP closest to the tilting target ground shape ST among the plurality of candidate regulation points RPc set in the bucket 8 does not exceed the tilting target ground shape ST.

The restriction speed determination unit 58 determines a restriction speed U for the tilting speed of the bucket 8 based on the operation distance Da. The restriction speed determination unit 58 restricts the tilting speed when the operation distance Da is equal to or shorter than a line distance H which is a threshold value.

Figure 17:
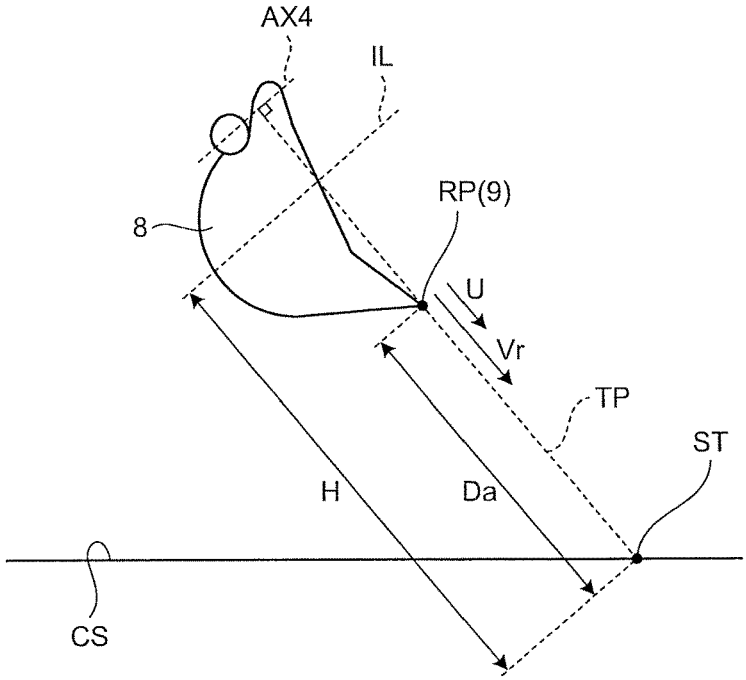
FIG. 17 is a schematic diagram illustrating an example of a tilting target ground shape according to the embodiment.

FIG. 17 is a schematic diagram illustrating the tilting stop control according to the embodiment. As illustrated in FIG. 17, the target construction ground shape CS is defined and a speed restriction intervention line IL is defined. The speed restriction line IL is parallel to the tilting axis AX4 and is defined at a position separated from the tilting target ground shape ST by the line distance H. It is desirable to set the line distance H so that the operation feeling of the operator is not damaged. The working device control unit 57 restricts the tilting speed of the bucket 8 when at least a part of the tilting bucket 8 exceeds the speed restriction intervention line IL so that the operation distance Da becomes equal to or shorter than the line distance H. The restriction speed determination unit 58 determines the restriction speed U for the tilting speed of the bucket 8 exceeding the speed restriction intervention line IL. In the example illustrated in FIG. 17, since a part of the bucket 8 exceeds the speed restriction intervention line IL so that the operation distance Da becomes shorter than the line distance H, the tilting speed is restricted.

The restriction speed determination unit 58 acquires the operation distance Da between the tilting target ground shape ST and the regulation point RP in a direction parallel to the tilting operation plane TP. Further, the restriction speed determination unit 58 acquires the restriction speed U in response to the operation distance Da. When the working device control unit 57 determines that the operation distance Da is equal to or shorter than the line distance H, the tilting speed is restricted.

Figure 18:
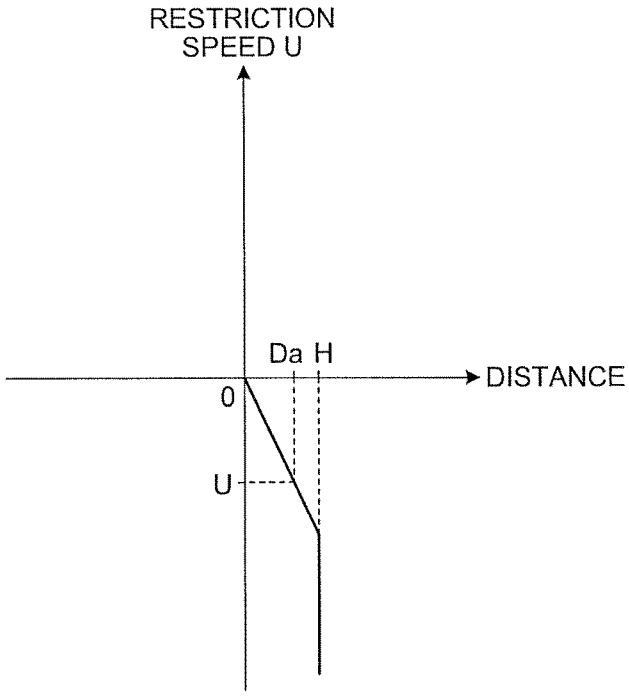
FIG. 18 is a schematic diagram illustrating an example of the tilting target ground shape according to the embodiment.

FIG. 18 is a diagram illustrating an example of a relation between the operation distance Da and the restriction speed U according to the embodiment. FIG. 18 illustrates an example of a relation between the operation distance Da and the restriction speed U for stopping the tilting of the bucket 8 based on the operation distance Da. As illustrated in FIG. 18, the restriction speed U is a speed which is uniformly set in response to the operation distance Da. The restriction speed U is not set when the operation distance Da is longer than the line distance H and is set when the operation distance Da is equal to or shorter than the line distance H. As the operation distance Da decreases, the restriction speed U decreases. When the operation distance Da becomes zero, the restriction speed U also becomes zero. Furthermore, in FIG. 18, a direction moving closer to the target construction ground shape CS is indicated by a negative direction.

The restriction speed determination unit 58 calculates a movement speed Vr obtained when the regulation point RP moves toward the target construction ground shape CS (the tilting target ground shape ST) based on the manipulation amount of the tilting manipulation lever 30T of the manipulation device 30. The movement speed Vr is the movement speed of the regulation point RP within a plane parallel to the tilting operation plane TP. The movement speed Vr is calculated for each of the plurality of regulation points RP.

In the embodiment, when the tilting manipulation lever 30T is manipulated, the movement speed Vr is calculated based on a current value output from the tilting manipulation lever 30T. When the tilting manipulation lever 30T is manipulated, a current set in response to the manipulation amount of the tilting manipulation lever 30T is output from the tilting manipulation lever 30T. The storage unit 59 can store a cylinder speed of the tilting cylinder 14 in response to the manipulation amount of the tilting manipulation lever 30T. Furthermore, the cylinder speed may be obtained by the detection of the cylinder stroke sensor. After the cylinder speed of the tilting cylinder 14 is calculated, the restriction speed determination unit 58 converts the cylinder speed of the tilting cylinder 14 into the movement speed Vr of each of the plurality of regulation points RP of the bucket 8 by using a Jacobian matrix.

When the working device control unit 58 determines that the operation distance Da is equal to or shorter than the line distance H, the movement speed Vr of the regulation point RP for the target construction ground shape CS is restricted to the restriction speed U. The working device control unit 58 outputs a control signal to the control valve 37 in order to suppress the movement speed Vr of the regulation point RP of the bucket 8. The working device control unit 58 outputs a control signal to the control valve 37 so that the movement speed Vr of the regulation point RP of the bucket 8 becomes the restriction speed U in response to the operation distance Da. Accordingly, a movement speed RP of the regulation point RP of the tilting bucket 8 becomes slower as the regulation point RP becomes closer to the target construction ground shape CS (the tilting target ground shape ST) and becomes zero when the regulation point RP (the tip 9) reaches the target construction ground shape CD.

Figure 19:
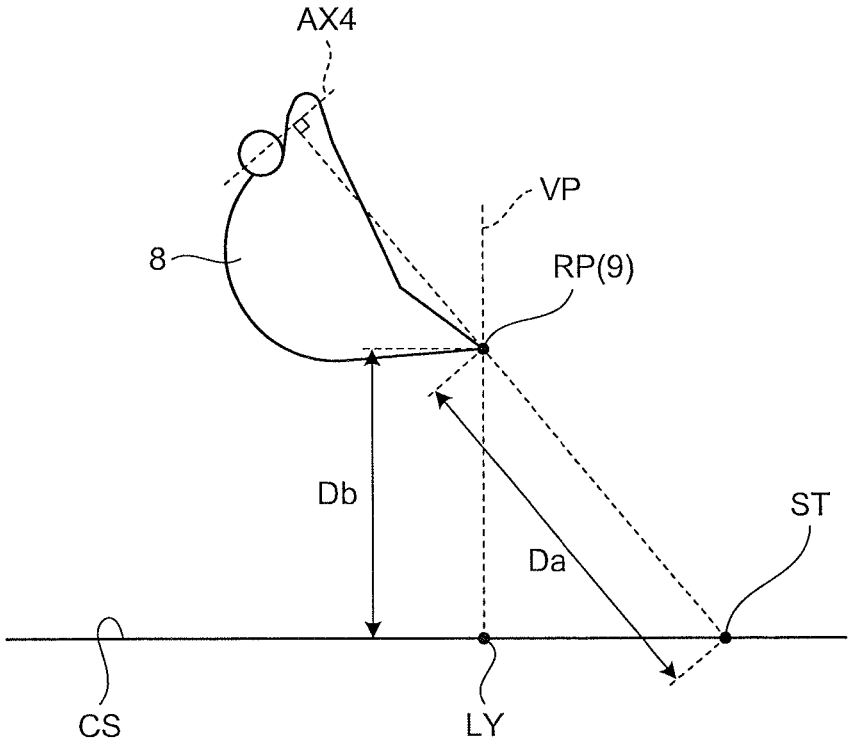
FIG. 19 is a schematic diagram illustrating a tilting stop control according to the embodiment.

FIG. 19 is a schematic diagram illustrating an action of the bucket 8 according to the embodiment. As illustrated in FIG. 19, the bucket 8 is tilted while the tilting axis AX4 is inclined with respect to the target construction ground shape CS. In the example illustrated in FIG. 19, the operation distance Da between the tilting bucket 8 and the target construction ground shape CS is sufficient and the possibility in which the tilting bucket 8 exceeds the target construction ground shape CS about the tilting axis AX4 is low. In the state illustrated in FIG. 19, when the tilting stop control is performed based on the perpendicular distance Db between the target construction ground shape CS and the tip 9 in the normal direction of the target construction ground shape CS, that is, the tilting stop control is performed based on the line LY extending in the Y-axis direction, the tilting stop control is performed based on the perpendicular distance Db shorter than the operation distance Da although the operation distance Da between the tilting bucket 8 and the target construction ground shape CS is sufficient and the possibility in which the tilting bucket 8 exceeds the target construction ground shape CS about the tilting axis AX4 is low. The lateral operation plane VP indicates a plane which is orthogonal to the working device operation plane WP and passes through the point AP (see FIG. 13). When the tilting stop control is performed based on the perpendicular distance Db shorter than the operation distance Da, there is a possibility that the tilting of the bucket 8 is unnecessarily stopped. When the tilting of the bucket 8 is unnecessarily stopped, the working efficiency of the excavator 100 is deteriorated. Further, when the tilting of the bucket 8 is unnecessarily stopped, the operator feels stress.

In the embodiment, the tilting operation plane TP is defined and the tilting target ground shape ST which is an intersection line between the tilting operation plane TP and the target construction ground shape CS is derived. The working device control unit 57 performs the tilting stop control so that the regulation point RP does not exceed the target construction ground shape CS based on the operation distance Da between the target construction ground shape CS and the regulation point RP closest to the tilting target ground shape ST among the plurality of candidate regulation points RPc. Since the tilting stop control is performed based on the operation distance Da longer than the perpendicular distance Db, it is possible to suppress the unnecessary stop of the tilting of the bucket 8 compared with a case where the tilting stop control is performed based on the perpendicular distance Db.

Figure 20:
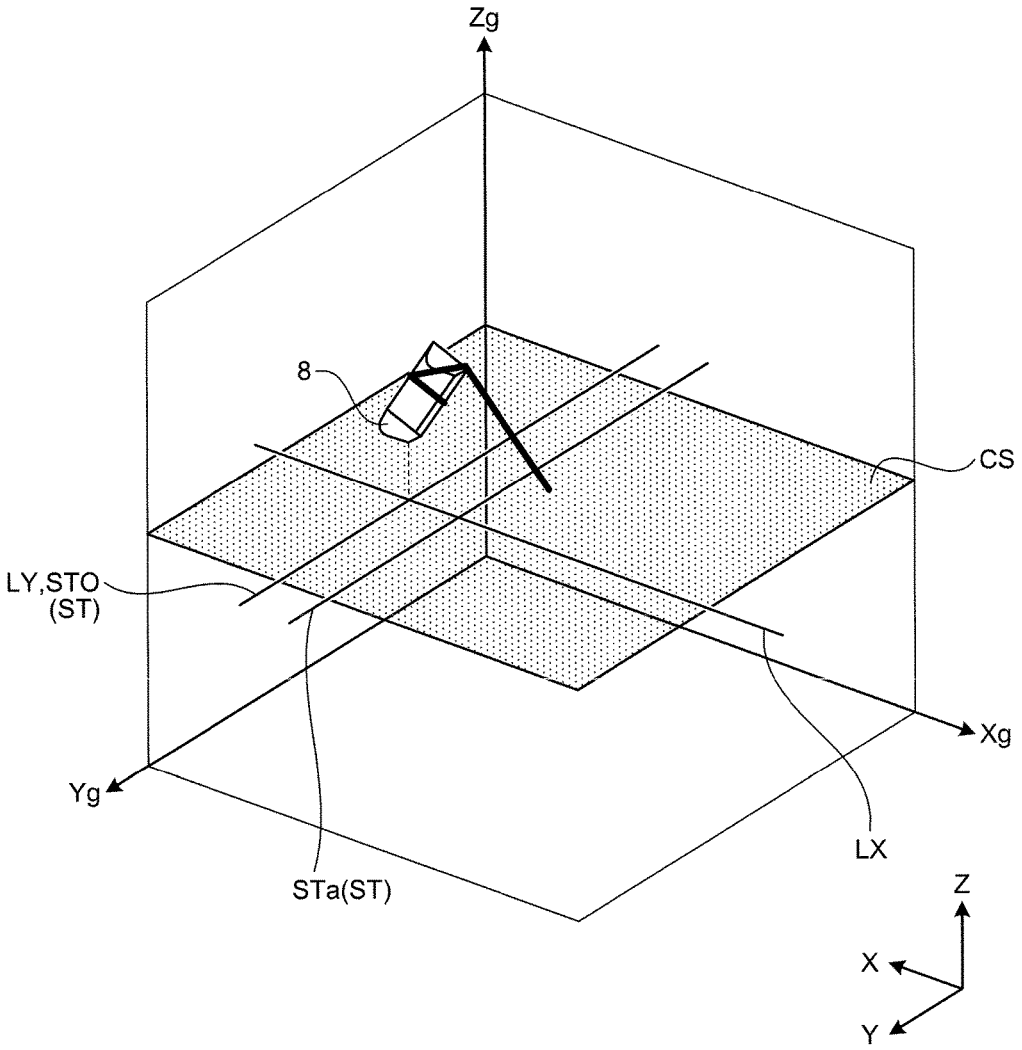
FIG. 20 is a diagram illustrating an example of a relation between an operation distance and a restriction speed according to the embodiment.
Figure 21:
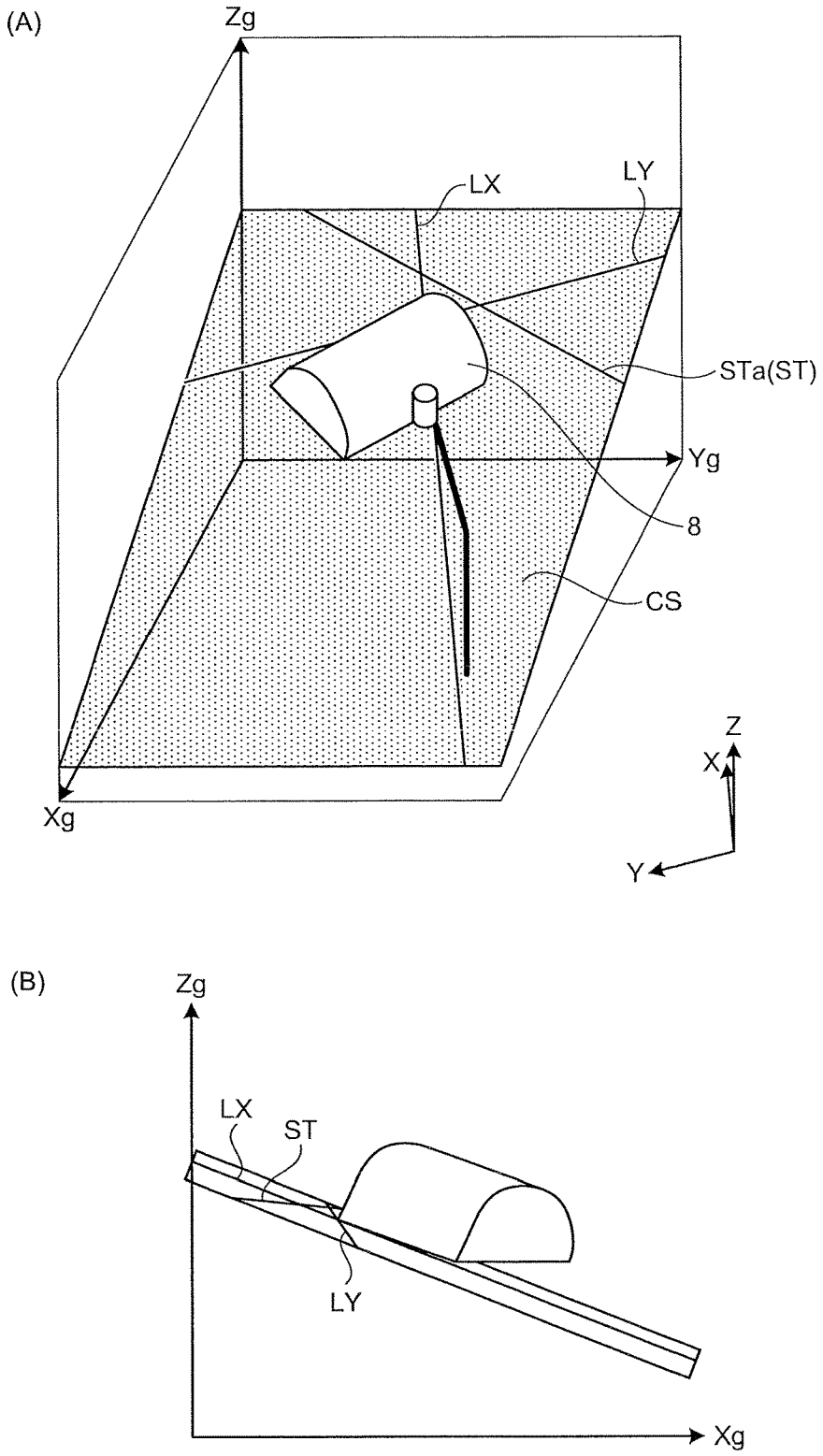
FIG. 21 is a schematic diagram illustrating an operation of the bucket according to the embodiment.

FIGS. 20 and 21 are schematic diagrams illustrating an example of the tilting target ground shape ST according to the embodiment. FIG. 20 is a diagram illustrating the tilting target ground shape ST when the target construction ground shape CS is parallel to the XY plane which is the reference plane of the upper swinging body 2. FIG. 21 is a diagram illustrating the tilting target ground shape ST when the target construction ground shape CS is inclined with respect to the XY plane. When at least one of the boom cylinder 11, the arm cylinder 12, and the bucket cylinder 13 is operated from a state where the tilting axis AX4 is parallel to the target construction ground shape CS so that the tilting axis AX4 is inclined with respect to the target construction ground shape CS, the tilting target ground shape ST moves from a tilting target ground shape ST0 to a tilting target ground shape STa. In the example illustrated in FIG. 20, the target construction ground shape CS is parallel to the XY plane and the tilting target ground shape ST moves from the tilting target ground shape ST0 to the tilting target ground shape STa in parallel. In the example illustrated in FIG. 20, the tilting target ground shape ST (ST0, STa) extends in the vehicle width direction which is parallel to the bucket axis AX3.

In the example illustrated in FIG. 20, a sequence of the tilting stop control based on the line LY (the tilting target ground shape ST0) is substantially the same as a sequence of the tilting stop control based on the tilting target ground shape ST moved from the line LY in parallel. That is, in the example illustrated in FIG. 20, if the regulation point RP moves closer to the target construction ground shape CS by the tilting of the bucket 8 when the tilting axis AX4 is parallel to the target construction ground shape CS and the tilting axis AX4 is not parallel to the target construction ground shape CS, the same effect as that of the tilting stop control of stopping the tilting of the bucket 8 is obtained.

FIG. 21 illustrates a state where the bucket 8 is tilted while the target construction ground shape CS is inclined toward the +X direction in the +Z direction as an example. The line LY extends in the vehicle width direction of the upper swinging body 2. The target construction ground shape CS is not parallel to the XY plane and the tilting target ground shape ST does not move in parallel when the bucket 8 is tilted. In the example illustrated in FIG. 21, the tilting target ground shape ST extends in the lateral direction of the bucket 8, but is not parallel to the bucket axis AX3.

In the state illustrated in FIG. 21, the tilting stop control is not performed based on the distance between the regulation point RP of the bucket 8 and the tilting target ground shape ST. When the tilting stop control is performed based on the distance between the regulation point RP of the bucket 8 and the line LY, it is difficult to appropriately perform the tilting stop control. That is, when the tilting stop control is performed based on the line LY, the distance between the regulation point RP and the line LY becomes a near distance in which the restriction is performed (the tilting is restricted) and thus there is a possibility that the tilting of the bucket 8 is unnecessarily stopped.

In the embodiment, the tilting stop control is performed based on the distance between the regulation point RP of the bucket 8 and the tilting target ground shape ST. When the tilting stop control is performed based on the operation distance Da between the regulation point RP of the bucket 8 and the tilting target ground shape ST even when the target construction ground shape CS is inclined, the unnecessary stop of the tilting of the bucket 8 is suppressed since the operation distance Da is a sufficient distance in which the restriction is not performed and thus the tilting stop control is appropriately performed.

Figure 22:
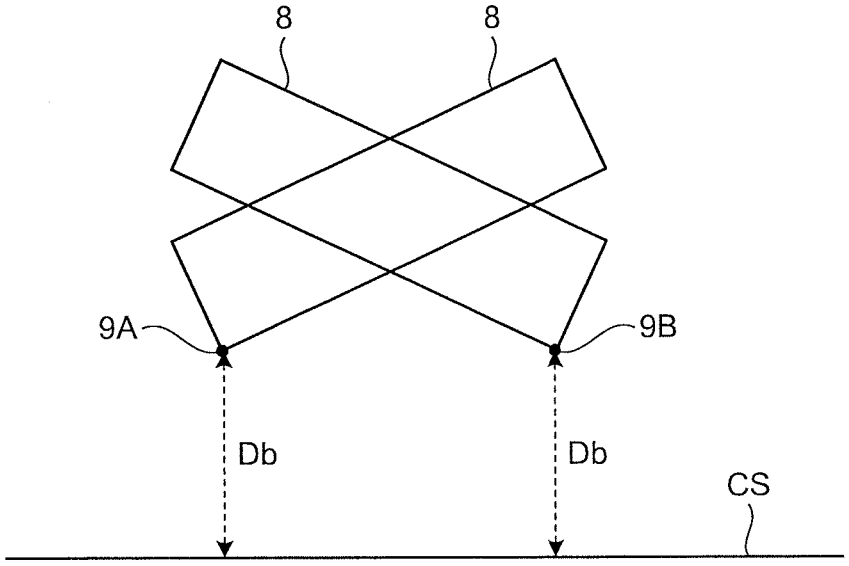
FIG. 22 is a schematic diagram illustrating an operation of the bucket according to the embodiment.
Figure 23:
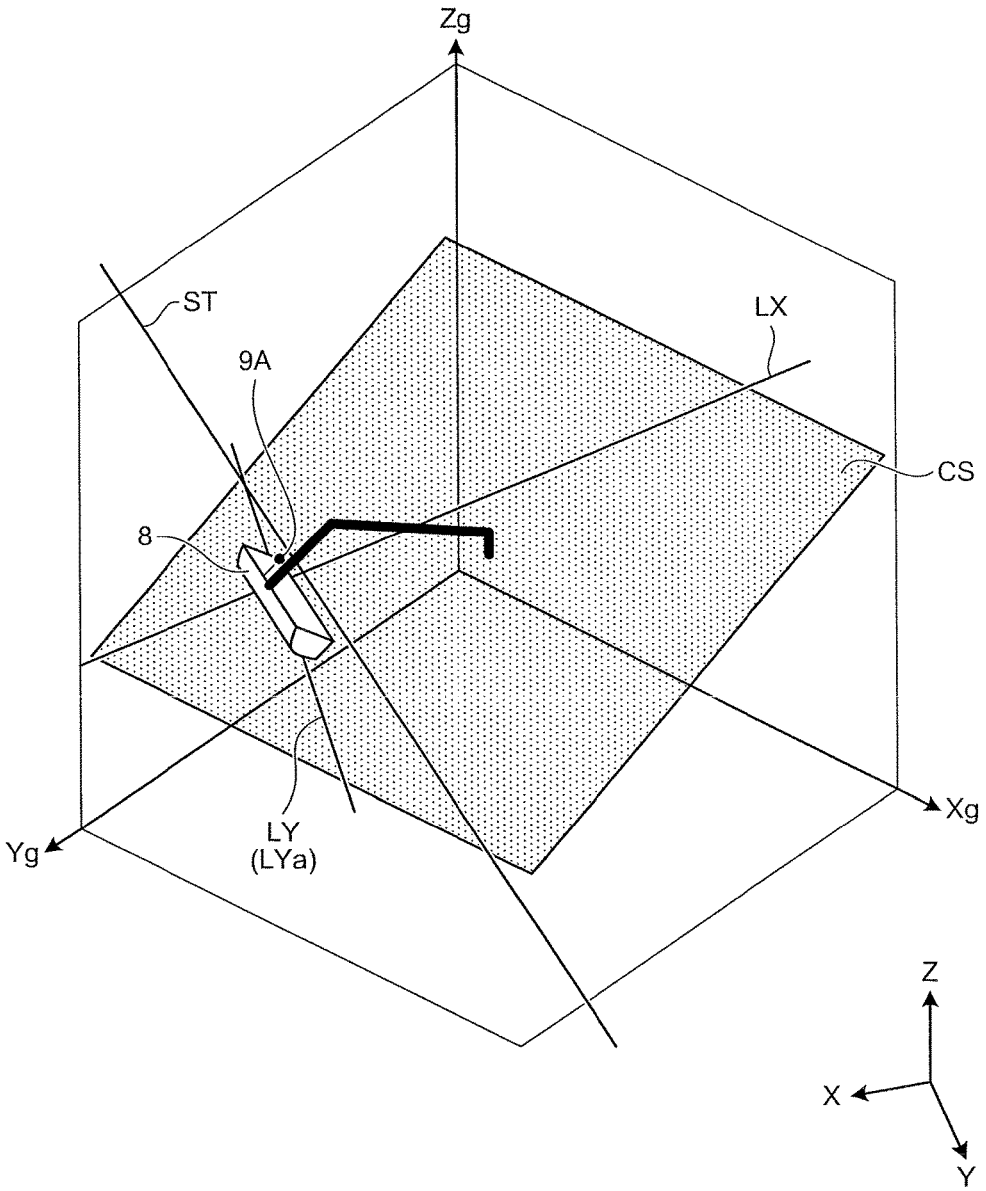
FIG. 23 is a schematic diagram illustrating an operation of the bucket according to the embodiment.
Figure 24:
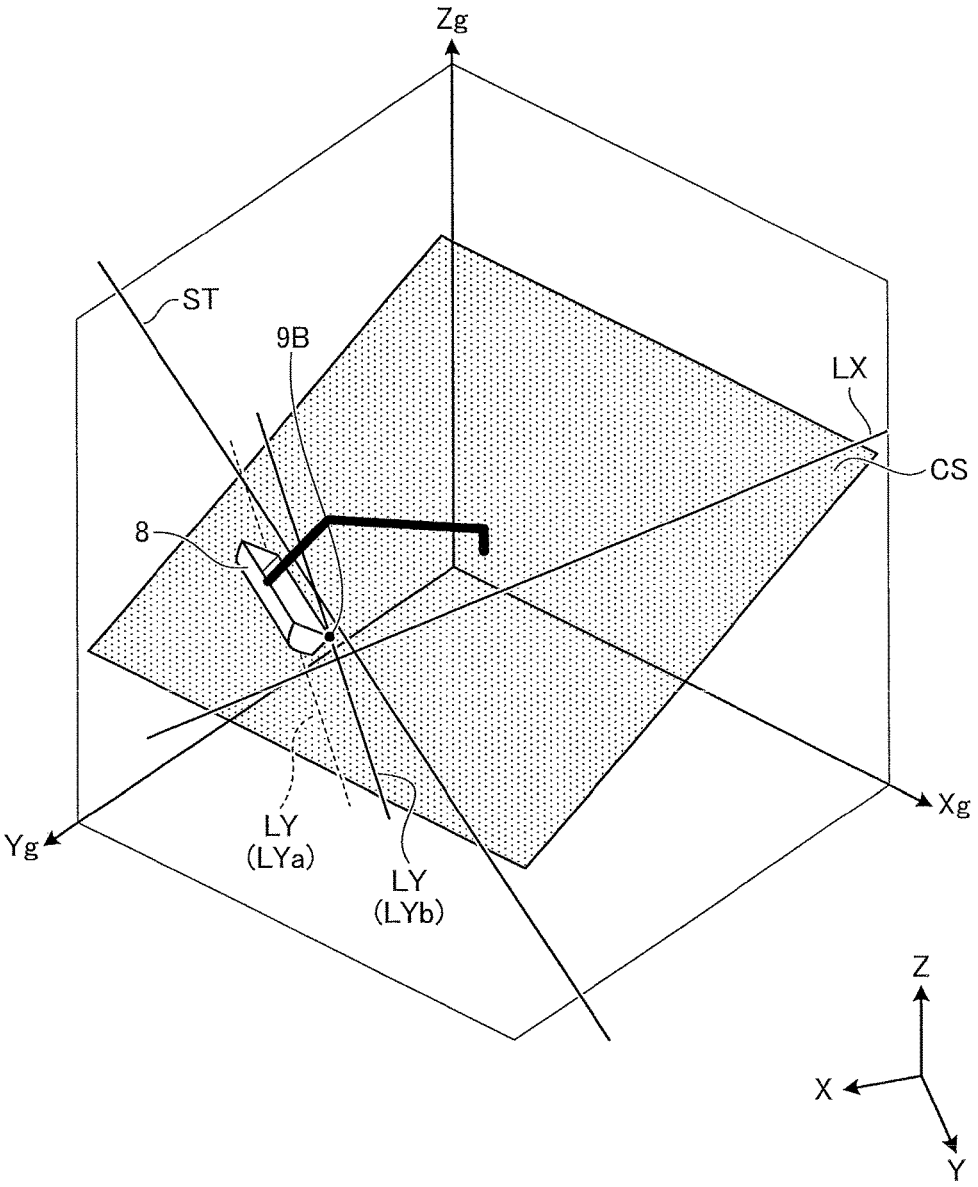
FIG. 24 is a schematic diagram illustrating an operation of the bucket according to the embodiment.

Further, a comparison of the tilting stop control using the tilting target ground shape ST or the line LY will be described based on a case where the bucket 8 is tilted while the upper swinging body 2 is inclined with respect to the target construction ground shape CS as illustrated in FIGS. 22, 23, and 24. As illustrated in FIG. 22, the portion of the bucket 8 (the tip 9) having a shortest perpendicular distance Db with respect to the target construction ground shape CS changes when the bucket 8 is tilted. When the bucket is tilted at a first tilting angle, a portion 9A which is a left bucket end of the tip 9 of the bucket 8 is closest to the target construction ground shape CS. When the bucket is tilted from the first tilting angle to a second tilting angle, a portion 9B which is a right bucket end of the tip 9 of the bucket 8 moves to a position closest to the target construction ground shape CS.

As illustrated in FIG. 22, when the bucket 8 is tilted so that the portion of the bucket 8 having the shortest perpendicular distance Db with respect to the target construction ground shape CS in the normal direction of the target construction ground shape CS changes, the position of the line LY having the shortest distance with respect to the portion of the bucket 8 in the normal direction of the target construction ground shape CS changes from the portion 9A to the portion 9B in the target construction ground shape CS. That is, there is a case where the position of the line LY in the target construction ground shape CS having the shortest distance with respect to the portion 9A in the normal direction of the target construction ground shape CS and the position of the line LY in the target construction ground shape CS having the shortest distance with respect to the portion 9B are different in accordance with the inclination relation between the target construction ground shape and the vehicle body. In other words, when the bucket 8 is tilted, the position of the line LY defining the perpendicular distance Db changes.

The above-described example will be described with reference to FIGS. 23 and 24. FIGS. 23 and 24 are diagrams illustrating a state where the line LY defining the perpendicular distance Db changes when the bucket 8 is tilted. FIGS. 23 and 24 illustrate a state where the line LY changes when the upper swinging body 2 is inclined toward the lateral direction (the +Y direction or the −Y direction) and the front direction (the +X direction). If the position of the line LY changes from a line LYa of FIG. 23 to a line LYb of FIG. 24 by the tilting of the bucket 8 when the tilting stop control is performed based on the line LY, the perpendicular distance Db suddenly changes. As a result, there is a phenomenon in which the tilting of the bucket 8 is suddenly stopped after the restriction speed U is changed. There is a possibility that this behavior may give uncomfortable feeling to the operator or give shock to the operator.

On the other hand, in the tilting stop control using one tilting target ground shape ST, the position of the tilting target ground shape ST does not change only by the tilting of the bucket 8. Thus, it is possible to prevent the operator from feeling uncomfortable due to the sudden stop of the tilting and thus to smoothly perform an excavating operation without any uncomfortable feeling of the operator while the tilting is ensured.

As illustrated in FIG. 22, when the bucket 8 is tilted so that the portion of the bucket 8 having the shortest perpendicular distance Db with respect to the target construction ground shape CS in the normal direction of the target construction ground shape CS changes, the position of the line LY having the shortest distance with respect to the portion of the bucket 8 in the normal direction of the target construction ground shape CS changes in the target construction ground shape CS. That is, as illustrated in FIG. 22, the position of the line LY in the target construction ground shape CS having the shortest distance with respect to the portion 9A in the normal direction of the target construction ground shape CS is different from the position of the line LY in the target construction ground shape CS having the shortest distance with respect to the portion 9B. In other words, when the bucket 8 is tilted, the position of the line LY defining the perpendicular distance Db changes.

In the embodiment, the position of the tilting target ground shape ST does not change only by the tilting of the bucket 8. Thus, the excavating operation using the tiltable bucket 8 is smoothly performed.

[Control Method]

Figure 25:
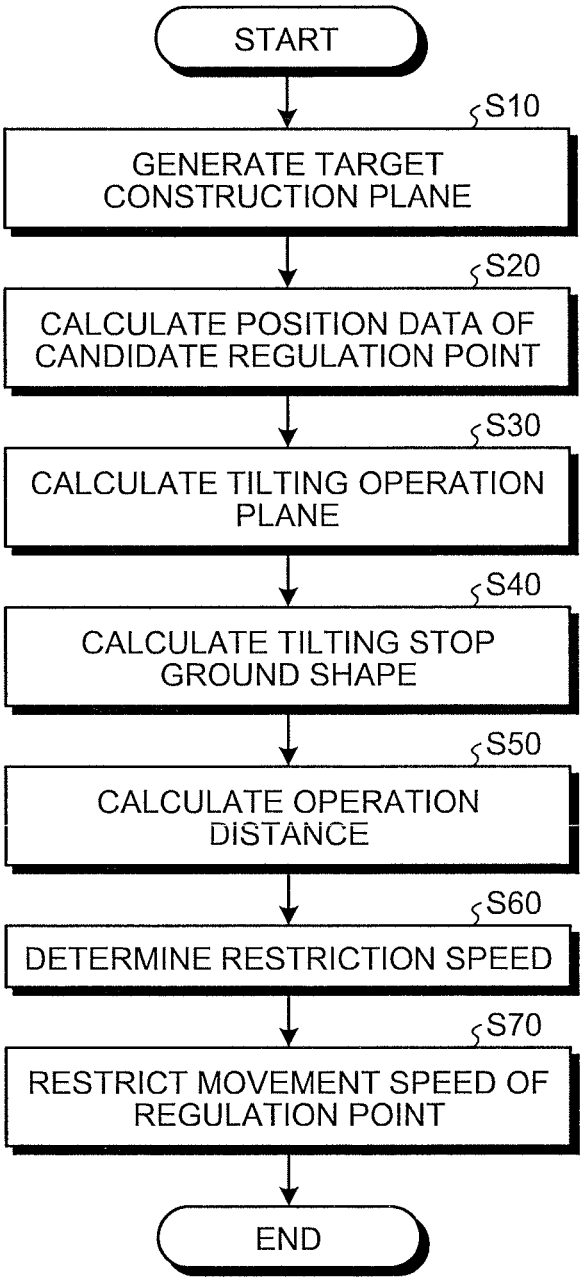
FIG. 25 is a flowchart illustrating an example of an excavator control method according to the embodiment.

Next, an example of a method of controlling the excavator 100 according to the embodiment will be described. FIG. 25 is a flowchart illustrating an example of the method of controlling the excavator 100 according to the embodiment.

The target construction ground shape generation unit 54 generates the target construction ground shape CS based on the line LX and the line LY which are the target construction data supplied from the target construction data generation device 70 (step S10).

The candidate regulation point data calculation unit 53B calculates the position data of each of the plurality of candidate regulation points RPc set in the bucket 8 based on the working device angle data acquired by the working device angle data acquisition unit 52 and the working device data stored in the storage unit 59 (step S20).

The tilting data calculation unit 55 selects the regulation point RP which is most advantageous in the tilting bucket control from the plurality of candidate regulation points RPc and calculates the tilting operation plane TP which is orthogonal to the tilting axis AX4 along the selected regulation point RP (step S30).

The tilting target ground shape calculation unit 56 calculates the tilting target ground shape ST in which the target construction ground shape CS and the tilting operation plane TP intersect each other (step S40).

The restriction speed determination unit 58 calculates the operation distance Da between the regulation point RP and the tilting target ground shape ST (step S50).

The restriction speed is determined based on the operation distance Da. When the operation distance Da is equal to or shorter than the line distance H, the restriction speed determination unit 58 determines the restriction speed U in response to the operation distance Da (step S60).

The working device control unit 57 calculates a control signal for the control valve 37 based on the movement speed Vr of the regulation point RP of the bucket 8 calculated from the manipulation amount of the tilting manipulation lever 30T and the restriction speed U determined by the restriction speed determination unit 58. The working device control unit 57 calculates a control signal for keeping the movement speed Vr at the restriction speed U and outputs the control signal to the control valve 37. The control valve 37 controls the pilot pressure based on the control signal output from the working device control unit 57. Accordingly, the movement speed Vr of the regulation point RP of the bucket 8 is restricted (step S70).

[Effect]

As described above, according to the embodiment, since the tilting operation plane TP which is orthogonal to the tilting axis AX4 and passes through the regulation point RP of the bucket 8 and the tilting target ground shape ST in which the target construction ground shape CS and the tilting operation plane TP intersect each other are set in the tilting type bucket and the tilting stop control is performed based on the operation distance Da between the regulation point RP and the tilting target ground shape ST, the unnecessary stop of the tilting of the bucket 8 is suppressed. Thus, since the stress of the operator is alleviated, deterioration in working efficiency of the excavator 100 is suppressed.

Further, as described above with reference to FIGS. 16, 19, and 21, the tilting stop control according to the embodiment is effective since deterioration in working efficiency of the excavator 100 can be suppressed when the bucket 8 is tilted while the tilting axis AX is inclined with respect to the target construction ground shape CS.

Further, as described above with reference to FIGS. 22 to 24, if the tilting stop control is performed based on the line LY defining the perpendicular distance Db, the position of the line LY changes when the bucket 8 is tilted. As a result, there is a possibility that the restriction speed U suddenly changes or the tilting of the bucket 8 is suddenly stopped so that the operator feels uncomfortable or shock. According to the embodiment, the position of the tilting target ground shape ST that defines the operation distance Da does not change even when the bucket 8 is tilted. Thus, the excavating operation using the tiltable bucket 8 is smoothly performed.

Figure 26:
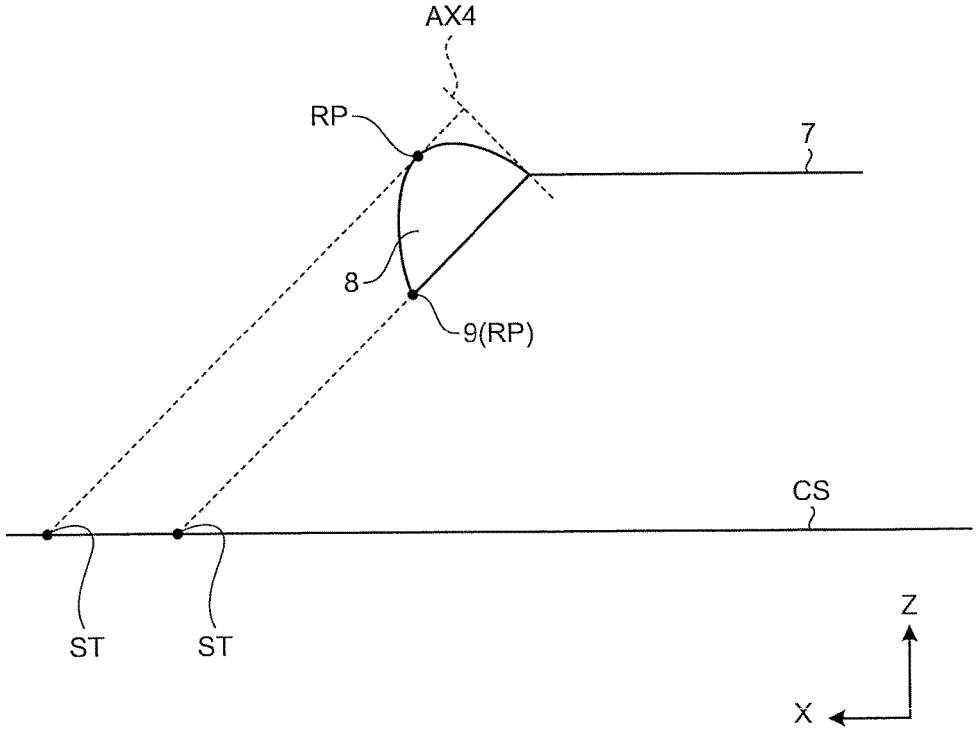
FIG. 26 is a schematic diagram illustrating an example of a tilting operation plane according to the embodiment.

Furthermore, in the above-described embodiment, the tilting stop control is performed based on the operation distance Da between the target construction ground shape CS and the regulation point RP set in the tip 9 of the bucket 8. As illustrated in FIG. 26, the tilting stop control may be performed based on the operation distance Da between the target construction ground shape CS and the regulation point RP set in the outer face of the bucket 8.

Furthermore, in the above-described embodiment, the tilting bucket 8 is stopped at the tilting target ground shape ST. The tilting stop control may be performed so that the tilting of the bucket 8 is stopped at a regulation position which is different from the tilting target ground shape ST and has a regulation position relation with respect to the tilting target ground shape ST.

Furthermore, the tilting stop control of stopping the tilting during manipulation is performed as the control for the tilting. However, an intervention control may be performed in which the control device determines a control instruction in a direction opposite to a manipulation instruction during manipulation.

Furthermore, in the above-described embodiment, the construction machine 100 is an excavator. The components described in the above-described embodiment can be applied to a construction machine including a working device different from the excavator.

Furthermore, in the above-described embodiment, the working device 1 may be provided with a rotation axis rotatably supporting the bucket 8 in addition to the bucket axis AX3 and the tilting axis AX4.

Furthermore, in the above-described embodiment, the upper swinging body 2 may swing by a hydraulic pressure or power generated by an electric actuator. Further, the working device 1 may be operated by power generated by the electric actuator instead of the hydraulic cylinder 10.

REFERENCE SIGNS LIST

1 WORKING DEVICE
2 UPPER SWINGING BODY
3 LOWER TRAVELING BODY
3C CRAWLER
4 CAB
5 MACHINE ROOM
6 BOOM
7 ARM
8 BUCKET
8B BUCKET PIN
8T TILTING PIN
9 TIP
10 HYDRAULIC CYLINDER
10A CAP SIDE OIL CHAMBER
10B ROD SIDE OIL CHAMBER
11 BOOM CYLINDER
12 ARM CYLINDER
13 BUCKET CYLINDER
14 TILTING CYLINDER
16 BOOM STROKE SENSOR
17 ARM STROKE SENSOR
18 BUCKET STROKE SENSOR
19 TILTING STROKE SENSOR
20 POSITION CALCULATION DEVICE
21 VEHICLE BODY POSITION CALCULATOR
22 POSTURE CALCULATOR
23 ORIENTATION CALCULATOR
24 WORKING DEVICE ANGLE CALCULATION DEVICE
25 FLOW RATE CONTROL VALVE
30 MANIPULATION DEVICE
30F MANIPULATION PEDAL
30L WORKING DEVICE MANIPULATION LEVER
30T TILTING MANIPULATION LEVER
31 MAIN HYDRAULIC PUMP
32 PILOT PRESSURE PUMP
33A, 33B OIL PASSAGE
34A, 34B PRESSURE SENSOR
35A, 35B OIL PASSAGE
36A, 36B SHUTTLE VALVE
37A, 37B CONTROL VALVE
38A, 38B OIL PASSAGE
50 CONTROL DEVICE
51 VEHICLE BODY POSITION DATA ACQUISITION UNIT
52 WORKING DEVICE ANGLE DATA ACQUISITION UNIT
53A REGULATION POINT POSITION DATA CALCULATION UNIT
53B CANDIDATE REGULATION POINT DATA CALCULATION UNIT
54 TARGET CONSTRUCTION GROUND SHAPE GENERATION UNIT
55 TILTING DATA CALCULATION UNIT
56 TILTING TARGET GROUND SHAPE CALCULATION UNIT
57 WORKING DEVICE CONTROL UNIT
58 RESTRICTION SPEED DETERMINATION UNIT
59 STORAGE UNIT
60 INPUT/OUTPUT UNIT

70 TARGET CONSTRUCTION DATA GENERATION DEVICE
81 BOTTOM PLATE
82 REAR PLATE
83 UPPER PLATE
84 SIDE PLATE
85 SIDE PLATE
86 OPENING PORTION
87 BRACKET
88 BRACKET
90 CONNECTION MEMBER
91 PLATE MEMBER
92 BRACKET
93 BRACKET
94 FIRST LINK MEMBER
94P FIRST LINK PIN
95 SECOND LINK MEMBER
95P SECOND LINK PIN
96 BUCKET CYLINDER TOP PIN
97 BRACKET
100 EXCAVATOR (CONSTRUCTION MACHINE)
200 CONTROL SYSTEM
300 HYDRAULIC SYSTEM
400 DETECTION SYSTEM
AP POINT
AX1 BOOM AXIS
AX2 ARM AXIS
AX3 BUCKET AXIS
AX4 TILTING AXIS
CD TARGET CONSTRUCTION DATA
CS TARGET CONSTRUCTION GROUND SHAPE
Da OPERATION DISTANCE
Db PERPENDICULAR DISTANCE
L1 BOOM LENGTH
L2 ARM LENGTH
L3 BUCKET LENGTH
L4 TILTING LENGTH
L5 BUCKET WIDTH
LX LINE
LY LINE
RP REGULATION POINT
RPc CANDIDATE REGULATION POINT
RX SWING AXIS
ST TILTING TARGET GROUND SHAPE
TP TILTING OPERATION PLANE
$\alpha$ BOOM ANGLE
$\beta$ ARM ANGLE
$\gamma$ BUCKET ANGLE
$\delta$ TILTING ANGLE
$\varepsilon$ TILTING AXIS ANGLE
$\theta$1 ROLL ANGLE
$\theta$2 PITCH ANGLE
$\theta$3 YAW ANGLE

The invention claimed is:

1. A construction machine control system with a working device including an arm and a bucket being rotatable with respect to the arm about a bucket axis and a tilting axis orthogonal to the bucket axis, the construction machine control system comprising:

a target construction ground shape generation unit which generates a target construction ground shape indicating a target shape of an excavation target;

a tilting data calculation unit which calculates tilting data of the bucket tilted about the tilting axis;

a regulation point position data calculation unit which calculates position data of a regulation point set in the bucket based on external shape data of the bucket including at least width data of the bucket;

a tilting target ground shape calculation unit which calculates a tilting target ground shape extending in a lateral direction of the bucket in the target construction ground shape based on the position data of the regulation point, the target construction ground shape, and the tilting data; and a working device control unit which controls a tilting of the bucket based on a distance between the regulation point and the tilting target ground shape.

2. The construction machine control system according to claim 1, wherein the tilting data includes a tilting operation plane which passes through the regulation point and is orthogonal to the tilting axis, wherein the tilting target ground shape is defined by an intersection portion between the target construction ground shape and the tilting operation plane, and wherein the distance is an operation distance defined by the tilting target ground shape and the regulation point.

3. The construction machine control system according to claim 2, wherein the working device control unit performs a tilting stop control of stopping the tilting of the bucket based on the operation distance between the regulation point and the tilting target ground shape.

4. The construction machine control system according to claim 3, wherein the working device control unit performs the tilting stop control by tilting the bucket while the tilting axis is inclined with respect to the target construction ground shape so that the tilted bucket does not exceed a regulation position based on the target construction ground shape.

5. The construction machine control system according to claim 3, further comprising:

a candidate regulation point data calculation unit which calculates position data of a plurality of candidate regulation points set in the bucket from the external shape data of the bucket, wherein the working device control unit performs the tilting stop control based on the regulation point having the shortest operation distance among the plurality of candidate regulation points.

6. A construction machine comprising:

an upper swinging body;

a lower traveling body which supports the upper swinging body;

a working device which includes the arm and the bucket and is supported by the upper swinging body; and the construction machine control system according to claim 1.

7. A construction machine control method for a construction machine with a working device including an arm and a bucket being rotatable with respect to the arm about a bucket axis and a tilting axis orthogonal to the bucket axis, the construction machine control method comprising:

generating a target construction ground shape indicating a target shape of an excavation target;

calculating tilting data of the bucket tilted about the tilting axis;

calculating position data of a regulation point set in the bucket based on external shape data of the bucket including at least width data of the bucket;

calculating a tilting target ground shape extending in a lateral direction of the bucket in the target construction ground shape based on the position data of the regulation point, the target construction ground shape, and the tilting data; and outputting a control signal of controlling a tilting of the bucket based on a distance between the regulation point and the tilting target ground shape.

* * * * *